US005316124A

United States Patent [19]

Barnes et al.

[11] Patent Number: 5,316,124

[45] Date of Patent: May 31, 1994

[54] METHOD AND APPARATUS FOR A LOW-POWER, BATTERY-POWERED VENDING AND DISPENSING APPARATUS

[75] Inventors: Elwood E. Barnes, Cochranville; Ronald R. Bernardini, Downingtown; Geoffrey A. June, Aston, all of Pa.

[73] Assignee: Mars Incorporated, McLean, Va.

[21] Appl. No.: 972,099

[22] Filed: Nov. 5, 1992

Related U.S. Application Data

[63] Continuation of Ser. No. 610,031, Nov. 7, 1990, abandoned.

[51] Int. Cl.[5] ..... G07F 7/04

[52] U.S. Cl. ..... 194/206; 194/217; 382/7

[58] Field of Search ..... 194/200, 206, 207, 217, 194/218; 453/17; 382/1, 7

[56] References Cited

U.S. PATENT DOCUMENTS

| | | | |
|---|---|---|---|
| Re. 32,456 | 7/1987 | Ishii . | |
| 3,731,777 | 5/1973 | Burke et al. | 194/217 |
| 3,956,692 | 5/1976 | Weinberg | 194/319 X |
| 4,039,768 | 8/1977 | O'Maley . | |
| 4,231,026 | 10/1990 | Sullivan | 340/661 X |
| 4,356,903 | 11/1982 | Lemelson et al. | 194/217 |
| 4,498,570 | 2/1985 | King et al. . | |
| 4,572,403 | 2/1986 | Benaroya | 221/15 X |
| 4,663,538 | 5/1987 | Cotton et al. | 194/217 X |
| 4,679,150 | 7/1987 | Hayashi et al. | 194/217 X |
| 4,733,766 | 3/1988 | Roberts et al. | 194/240 |
| 4,848,556 | 7/1989 | Shah et al. | 194/350 X |
| 4,850,468 | 7/1989 | Kobayashi et al. | 194/207 |
| 4,876,532 | 10/1989 | Sauls | 221/3 X |
| 4,926,458 | 5/1990 | Reger et al. . | |
| 4,967,895 | 11/1990 | Speas | 194/200 |
| 4,979,208 | 12/1990 | Pruden et al. . | |
| 5,036,966 | 8/1991 | Kaspar et al. | 194/217 |

FOREIGN PATENT DOCUMENTS

| | | | |
|---|---|---|---|
| 4111093 | 4/1992 | Japan | 194/217 |
| 537702 | 11/1984 | Spain . | |
| 2151062 | 7/1985 | United Kingdom . | |

*Primary Examiner*—Frank E. Werner
*Assistant Examiner*—Scott L. Lowe
*Attorney, Agent, or Firm*—Davis Hoxie Faithfull & Hapgood

[57] ABSTRACT

The present invention relates to a method and apparatus for a money-operated, low-powered, vending and dispensing apparatus which is solely battery-powered and which can be utilized in the vending or dispensing of products or services. The present invention comprises at least one battery, a control system housed on a control board, money sensing and validating devices, circuitry to perform a battery power test and to indicate a low battery power condition, circuitry and devices to determine the acceptability of various types of money, or its equivalent, which could be accepted by the apparatus, and circuitry and devices to indicate such acceptability. The present invention further comprises a product delivery circuit and device, circuitry to indicate the activation, or lack thereof, of the product delivery device, and circuitry and a device to indicate when the apparatus is being serviced. The present invention utilizes many power saving components and devices, as well as power saving design and operational techniques, so as to facilitate low-powered operation. While the present invention is described, in its preferred embodiment, for use in an apparatus for the vending or dispensing of newspapers or other printed matter, it may find countless applications in other apparatus utilized in the vending or dispensing of products or services.

15 Claims, 15 Drawing Sheets

METHOD AND APPARATUS FOR A LOW-POWER, BATTERY-POWERED VENDING AND DISPENSING APPARATUS

This is a continuation of copending application Ser. No. 07/610,031 filed Nov. 7, 1990, now abandoned.

FIELD OF THE INVENTION

The present invention relates to the vending and dispensing of products or services from a low-power, battery-powered apparatus, and the control system for such an apparatus. While the present invention is applicable to the vending and dispensing of any product or service from a battery-powered apparatus, and also to any low-power, battery-powered apparatus that is actuated by money or its equivalent, the exemplary discussion which follows is primarily directed to the vending of newspapers and other printed matter. The application of the present invention to battery-powered apparatus other than for a newspaper vending machine will be apparent to one of ordinary skill in the art.

BACKGROUND OF THE INVENTION

Vending and dispensing machines play an important role in the distribution of numerous products and services to consumers in today's society. The types of items distributed in this manner include, but are not limited to, newspapers, food and drink items, cigarettes, stamps, transportation tickets and tokens, prophylactics, health-care items, toiletries, toys, and even video cassettes. The types of services which may be provided by these machines may include the allowance of entry to paying customers or users such as by turnstiles, etc. Such machines may include coin validation mechanisms for lower priced items and also currency validators for higher priced items.

One of the most prevalent vending and dispensing machines is the newspaper "honor box". To obtain a newspaper, the user inserts into the coin mechanism the amount of money (usually in coins) required to purchase the newspaper. If the coins are accepted, a door latch is released, the user takes a newspaper, and the door snaps back under a bias pressure and the door latch returns the door to its locked position.

Mechanical vending apparatus, such as conventional newspaper vending machines, have the disadvantage that they do not have sophisticated coin discrimination and validation means and, therefore, can be easily fooled by slugs and counterfeit coins. There is difficulty in providing mechanical devices which allow for the acceptance of a variety of coins and provide change to the customer or user. The typical mechanical coin mechanism requires exact change to be inserted using specific coins. Further, providing such a device which can accommodate price changing by day or by issue requires a considerable effort. Also, the ability to provide other special functions is severely limited in mechanical vending systems. Further, mechanical vending apparatus have no provisions for accepting or handling bills, other paper currency, or other money alternatives.

Electrically powered vending machines, which are powered from conventional or special AC outlets, allow for the use of sophisticated coin validation mechanisms and paper currency validators under the control of microprocessors. An example of such a coin validation mechanism is the Intellitrac TM Series mechanism sold by Mars Electronics, a subsidiary of the assignee of the present invention.

Electrically powered vending machines, although superior to mechanical vending machines in a number of ways, still have significant disadvantages. For example, if numerous electrically powered machines are placed closely adjacent to one another, there may not be sufficient access to the electrical power outlet(s) for all of the machines. Also, the power cords for the machines may become entangled or frayed, if the machines are moved or jostled. Also, electrically powered vending machines are totally unsuitable from a safety point of view for use in exposed, outdoor areas and also at many indoor locations.

Finally, electrically powered vending machines have the distinct disadvantage of requiring an AC voltage source. Clearly, AC outlets are not available in many places where such a vending machine would be located. This is particularly true with regard to newspaper vending machines, which are often placed at remote locations such as street corners, travel and subway platforms, and the like.

There remains a need for a vending and dispensing apparatus combining the flexibility and simplicity of mechanical devices and the sophistication and special features of an electrically powered device. Preferably such an apparatus would be battery powered and would consume a minimum amount of power and be able to operate for extended periods of time without the need for replacing, or recharging, the batteries. Such a machine must effectively perform the necessary vending and validation functions, including accepting both coins and paper currency.

SUMMARY OF THE INVENTION

The present invention relates to an efficient and cost effective apparatus and methods for achieving improved performance in a low-power, battery-powered vending or dispensing apparatus.

One aspect of the invention relates to an improved battery-powered newspaper vending machine.

Another aspect of the invention relates to an improved control system for a battery-powered dispensing or vending apparatus. Another aspect of this invention relates to low-power sensing of a coin validation mechanism, a bill validator, or other currency validation mechanism in a battery-powered vending or dispensing machine to determine whether a user has attempted to initiate a vending or dispensing cycle by depositing coins, bills, or other cash alternatives, into the apparatus. At this juncture, it is important to note that the use of the term "money" from this point on in the Specification and Claims refers to coins, bills, credit cards, value cards, tokens, coupons, and other cash alternatives.

Another aspect of this invention is determining the amount of energy remaining in a battery of a battery-powered apparatus, particularly a vending or dispensing machine, independent of environmental and operating conditions for the battery.

Another aspect of this invention is a low-powered means for a battery-powered apparatus, particularly a vending or dispensing machine, for indicating the charge status of the battery, but only at selected times.

Another aspect of this invention is a means for advising a user of a battery-powered vending or dispensing apparatus that the status of the apparatus is in at least one of at least two possible states, based on information determined by the control system of the apparatus at the last vending or dispensing event. The means for advising the user has at least two states. Energy is required only to change from one state to the other and not to maintain the status information in a particular state.

Another aspect of the invention relates to a low-power means for maintaining the actuation of a solenoid in a battery-powered vending and dispensing machine.

Another aspect of the present invention is a battery-powered vending apparatus having both a coin validation mechanism and a paper currency validator.

Another aspect of the present invention involves methods and apparatus for minimizing power consumption in a battery-powered vending or dispensing apparatus.

Other aspects of the present invention will be made clear from the detailed specification which follows.

DETAILED DESCRIPTION OF THE PREFERRED EMBODIMENT

Figure 1:
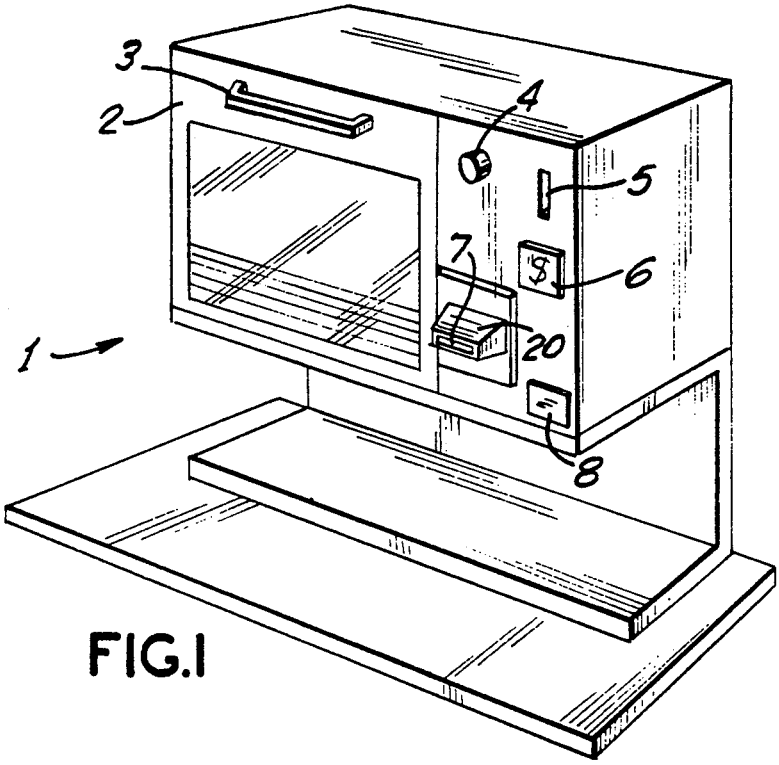
FIG. 1 is a perspective view of the preferred embodiment of the present invention, namely, a battery-powered apparatus for vending and dispensing newspapers and other printed matter.

In FIG. 1, the preferred embodiment of the present invention is shown as a battery-powered vending apparatus for dispensing newspapers and other printed matter. While the present invention is described in its preferred embodiment description as being utilized as a vending apparatus for newspapers, it is readily apparent that the present invention may be used for and with machines that vend or dispense other products, e.g., cigarettes, candy, drinks, prophylactics, health and beauty aids, toiletries, and sanitary materials, etc., as well as in service providing apparatus such as turnstiles, etc., or any other application requiring money validation utilizing a battery as the power source. Thus, the present invention may be utilized in any type of application where low-power consumption is required, batteries are to be the sole power source (thereby requiring low-power consumption), and in situations where the device, whatever it may be, experiences long and frequent idle or dead time periods which require a low-powered idle state, during which the device must be alert for any activity calling it into full powered operation at which point it must transition itself so as to provide a full powered operation.

Figure 2:
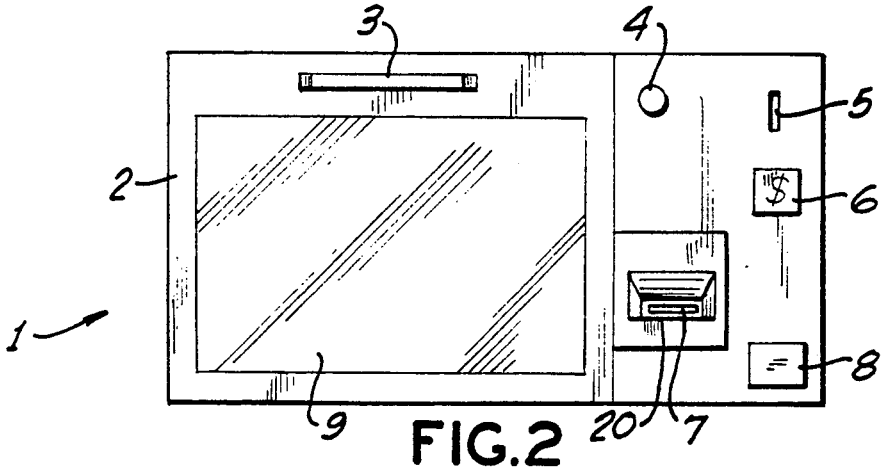
FIG. 2 is a front elevational view of the apparatus of FIG. 1.

FIG. 2 is a front elevational view of apparatus 1 of FIG. 1. Shown in FIG. 2 are a door 2, a door handle 3, an escrow return 4 used by the customer to initiate the return of his deposited funds, a coin slot 5 for the insertion of coins, a bill accept/coin accept only indicator 6 to provide the customer with information concerning the ability of the vending apparatus to accept coins or bills or coins only, a bill insert slot 7 for the insertion of bills, a coin return slot 8 for the return of change or rejected coins and a transparent window 9 for viewing the contents of the vending apparatus 1.

Figure 3:
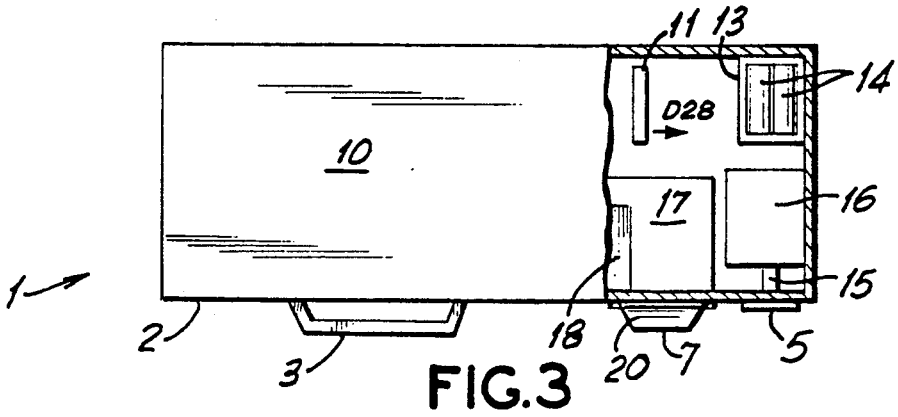
FIG. 3 is a top view, partly in section, of the apparatus of FIG. 1.

FIG. 3 is a top view, partly in section, of the vending apparatus 1 showing the placement of the various components therein. Shown in FIG. 3 are the newspaper compartment 10 where newspapers or other printed matter are stored, bill insert slot 7, coin slot 5, vending apparatus door 2, door release solenoid 18 to allow the opening of the door 2, door handle 3, Control Board 11 (which contains the control system to be described below), LOW BATTERY LED D28 to indicate low-battery power, battery compartment 13 for the placement of the batteries therein, batteries 14, coin mechanism 16, which performs coin validation as well as other important system functions to be described below, coin chute 15, which serves as the coin runway from the coin slot 5 and the coin mechanism 16 and bill insert slot 7, which is located in the bill snout 20, which services the bill validator 17, which in turn performs the validation of paper money.

Figure 4:
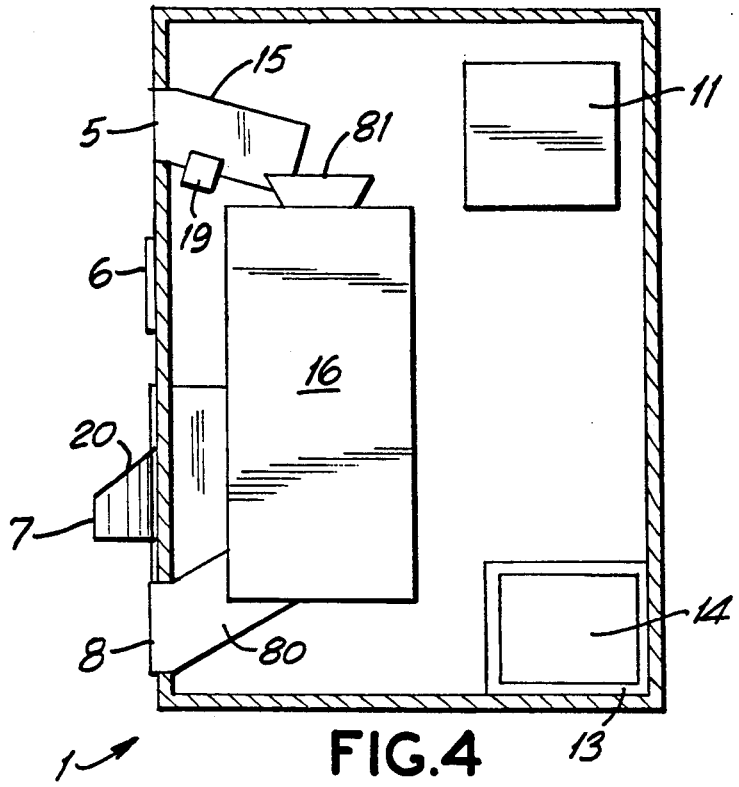
FIG. 4 is an elevational view, partly in section, of the apparatus of FIG. 1, viewed from the right side of FIG. 1.

FIG. 4 is a side elevational view in section of the apparatus 1 from the right side of the apparatus 1, with reference to FIG. 1. Shown in FIG. 4 are the coin slot 5, coin chute 15, coin mechanism 16, bill insert slot 7, bill validator 17, battery compartment 13, batteries 14, and the Control Board 11. Also shown in this figure are the bill snout 20 that houses the bill insert slot 7, coin WAKE-UP sensor 19 that senses the presence of coins, and the coin return chute 80 that delivers change or returns to the user rejected coins from the coin mechanism 16 and coin cup 81, which is a receiving element located atop the coin mechanism 16 and which receives the coins at the end of the coin chute 15.

Figure 4A:
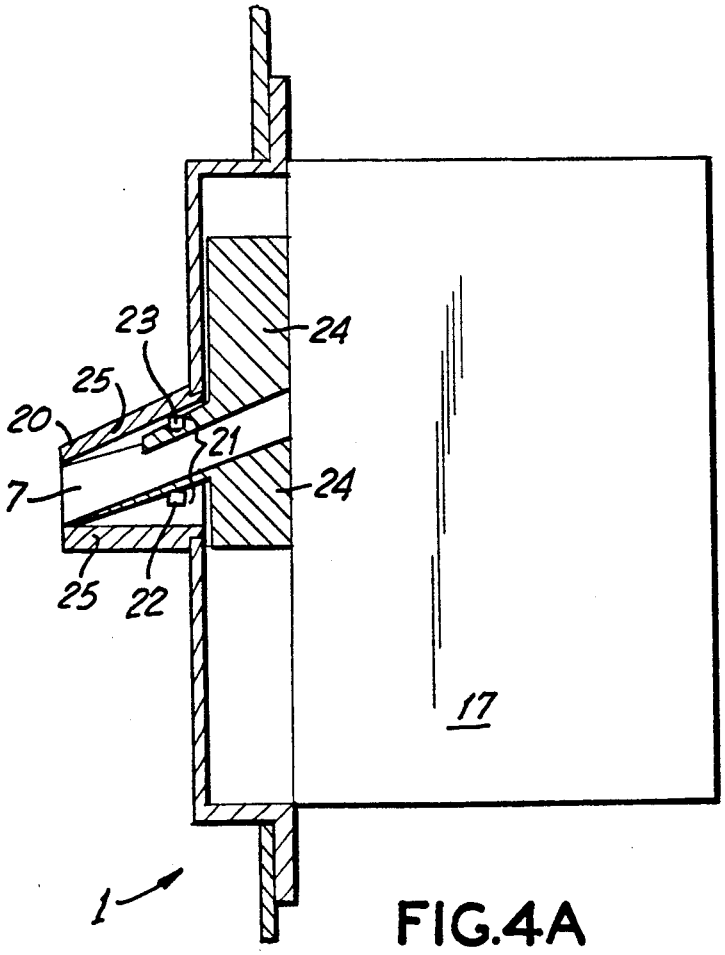
FIG. 4A is an enlarged detailed view of a portion of FIG. 4, particularly showing the bill validator snout.

FIG. 4A is a detailed view of a portion of FIG. 4, showing the bill sensor 21 located in the bill snout 20. The bill sensor 21 includes an LED 22 located below the bill insert slot passageway 7. Located above the insert slot passageway 7 in the shaded region is phototransistor 23. LED 22 is preferably a plastic IRED (infrared) LED such as Model OP140 produced by Optek. The phototransistor 23, the detector of light, is a silicon phototransistor and preferably Model OP550, also produced by Optek.

Referencing FIG. 4 and FIG. 4A, the coin wake-up sensor 19 is situated along the coin chute 15, in between the coin slot 5 in the front panel of the apparatus and the coin cup 81 located atop the coin mechanism 16, and is preferably a wide gap slotted optical switch such as an Optek Model OPB800W55. The walls 24 which define the bill insert slot 7, are composed of red plastic which facilitates the flow of light from the LED 22 to phototransistor 23. The entire bill snout 20 is protected by an opaque outer protective shell 25, which may be of a bezel-type construction. It is readily seen that when a bill is inserted into the slot 7, the light emanating from the LED 22 is blocked, and therefore, light impinging on the phototransistor 23 is reduced.

Note that, while electronic coin and bill detection means have been described as being utilized in the preferred embodiment of the present invention, other coin and bill detection means, which include, but are not limited to, those of the mechanical, optical, and acoustical variety, may also be employed.

The operation and interrelationship of the components of the apparatus 1 of the present invention are described below, particularly with regard to FIGS. 5 and 6.

Figure 5:
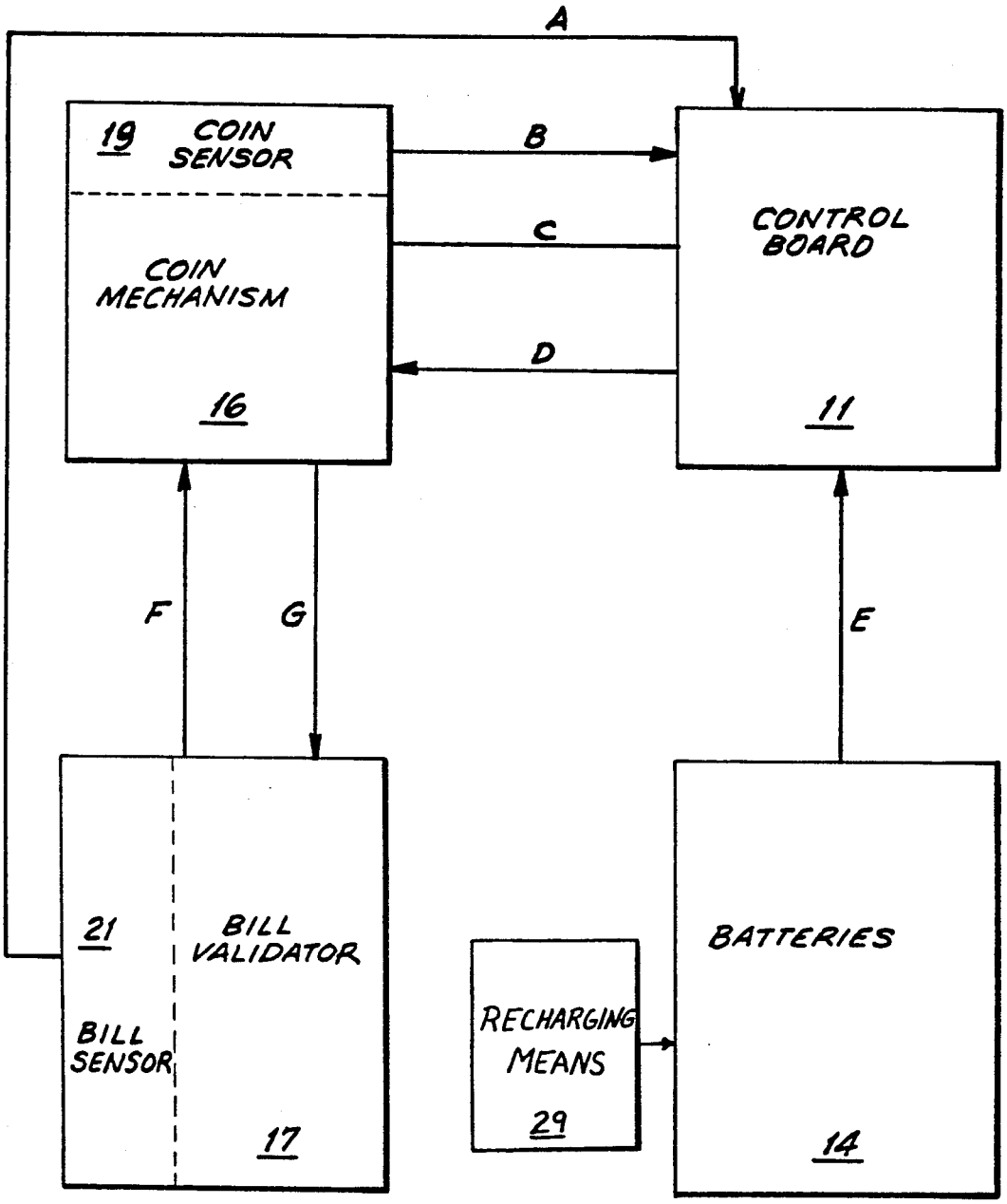
FIG. 5 is a block diagram of various components of the apparatus of FIG. 1, namely a coin mechanism and coin sensor, a bill validator and bill sensor, batteries, and a control board.

FIG. 5 is a block diagram of the basic operation of the apparatus 1 of the present invention, showing the four main components of the system. These components are the Control Board 11, the batteries 14, the coin mechanism 16 (with associated coin sensor 19) and the bill validator 17 (with associated bill sensor 21). Each of these main components will be described in turn.

The coin mechanism 16 is preferably a modified version of the Model TRC6700H unit manufactured and sold by Mars Electronics, a subsidiary of the assignee of the present invention. The coin mechanism 16 performs a variety of functions which include coin validation and acceptance, coin return, change inventory, change making, as well as providing signals to the Control Board 11 which are vital to control system operation and interfacing.

The vending price of the product or service is set on price switches which are located in, and form an integral part of, the coin mechanism 16. The vending price for the product or service is set in the Coin Mechanism-/Bill Validator Combination (TRC COMBO) on the Coin Mechanism 16 control board. Only one single vend price can be set on the TRC COMBO. Under any operating conditions, vending or dispensing is performed when the single vend price has been reached or exceeded. Other coin mechanism versions are possible that permit more than a single vend price to be set on the coin mechanism control board. One such mechanism is referred to as a four price coin mechanism as four separate vend prices can be set and retained by the coin mechanism. By appropriately connecting such a four vend price coin mechanism to a multiple position selection switch and to the other components and devices of the present invention, four separate prices can be set. This design feature permits service personnel to easily change the vend price from one preset price to a second preset price by the simple activation of a switching means. This provides for the easy changing of the vend price. Hence, the present invention allows for vend price changing for newspapers or other printed matter for daily and weekend editions. Such an arrangement would permit Evening and Special editions to be easily sold from the present invention. Further, by connecting the price switching device 32 to an electronic timer 34 (shown in FIG. 6) or clock, vend price can be changed at fixed times during the day. For example, prices on papers could be reduced at night in an attempt to sell papers that would otherwise be returned to the printers. The price would be returned back to the normal daily vend price in the morning or at some other time before the vending apparatus is due to be refilled.

The above described scheme is also possible with other coin mechanism types such as ten price and multiprice coin mechanisms. A variation of the above scheme would be to have one or more vend prices or their settings stored on the system Control Board 11 and having a means by which to have these prices or settings be conveyed to a multiprice coin mechanism.

These interfacing functions between the coin mechanism 16 and the Control Board 11, as well as the system peripherals will be evident from the description which follows. The manner in which the coin mechanism 16 validates and accepts coins, returns coins and makes change is well-known in the art and does not form a part of this invention.

The bill validator 17 is preferably a modified version of the VFM1 LO U2CS bill validator manufactured and sold by Mars Electronics. In the preferred embodiment, the bill validator 17, as signified by the prefix VFM1 (which stands for value for money with a one dollar bill being the only denomination accepted) accepts only one dollar bills, though a validator for any other bill or paper money denomination may be utilized. The bill validator 17 as shown in FIG. 5 interacts with the coin mechanism 16 in such ways as will be made apparent throughout the remainder of this disclosure. The manner in which the bill validator 17 validates or rejects bills is well known in the art, and does not form part of the invention.

The coin mechanism 16 and bill validator 17 are utilized in conjunction with one another to make up what is referred to as a TRC COMBO or combination. This combination simplifies the interconnection between the coin mechanism 16 and the bill validator 17, and is, therefore, incorporated into the preferred embodiment. However, the apparatus 1 need only contain a single validation mechanism if so desired, for example, a coin mechanism, a bill validator or some other money validator.

The Mars Electronics model TRC67OOH coin mechanism and model VFMI LO U2CS bill validator are each independently microprocessor controlled and are designed for 117 VAC operation. Since the present invention relates to a battery powered system, having in the preferred embodiment up to 24 VDC power available, modifications must be made to the hardware, software and physical attributes and dimensions of the TRC6700H and the VFMI LO U2CS units in order to adapt those units to the battery supply and also to the physical dimensions of the dispensing apparatus 1. These modifications are readily made by one skilled in the art and do not form part of the present invention. A description of the hardware modifications made to the Coin Mechanism 16 and to the Bill Validator 17 will be described below with reference to FIG. 11.

The coin wake-up sensor 19 and the bill sensor 21, as described earlier, operate in conjunction with the coin mechanism 16 and the bill validator 17, respectively. The coin wake-up sensor 19 is located in the coin chute 15 while the bill sensor 21 is located in the bill snout 20. The insertion of a coin or bill can be detected via these sensors by the Control Board 11.

The two batteries 14 constitute the DC power supply source for the system. The two batteries 14 in the preferred embodiment each provide 12 volts of DC power and are preferably of a modest size. Each battery typically has dimensions of approximately $3\frac{3}{4}'' \times 2\frac{1}{2}'' \times 6''$, with the capacity to provide 6 amp hours of current. The batteries 14 are utilized in series to provide both 12 VDC and 24 VDC to the various components of the coin mechanism 16 and bill validator 17, as well as other apparatus components.

While any type of battery may be employed in the present invention, batteries of the lead acid electrolyte type are used in the preferred embodiment. While a gelled electrolyte is preferable, so as to prevent spillage of battery acid in the vending apparatus, it should be noted that batteries with liquid, paste, or other forms of electrolytes may also be used, as well as those batteries having electrochemical means different from lead acid.

The Control Board 11 receives signals from the microprocessor in the coin mechanism 16. The circuitry on the Control Board 11 constitutes the control system for the apparatus 1. Among its many functions, the Control Board 11 monitors the system state as to whether coins or bills have been inserted. If any coins or bills are detected, the Control Board 11 applies power to the coin mechanism 16. The coin mechanism 16 then passes power on to the bill validator 17. The power is metered or timed and unless directed otherwise, 20 seconds after the unit is turned on, the Control Board 11 will turn off the power to the coin mechanism 16 and, therefore, to the bill validator 17. The coin mechanism 16 can extend the 20 second power up period or it can terminate it at any time prior thereto. The sensors 19 and 21 located at the openings of the coin mechanism 16 and bill validator 17, respectively, are strobed by the Control Board 11 for only a short time interval (milliseconds) at a rate of preferably a dozen times a second.

When strobing the sensors 19 and 21, the Control Board 11 is in a power conserving "nap" state. This control board strobing of the coin sensor 19 and the bill sensor 21 continues until the presence of a coin or bill is detected in the respective sensor, at which time the circuitry for the control system on the Control Board 11 is awakened and begins operation in the full powered state. The Control Board 11 receives all of its power requirements from the batteries 14.

Figure 6:
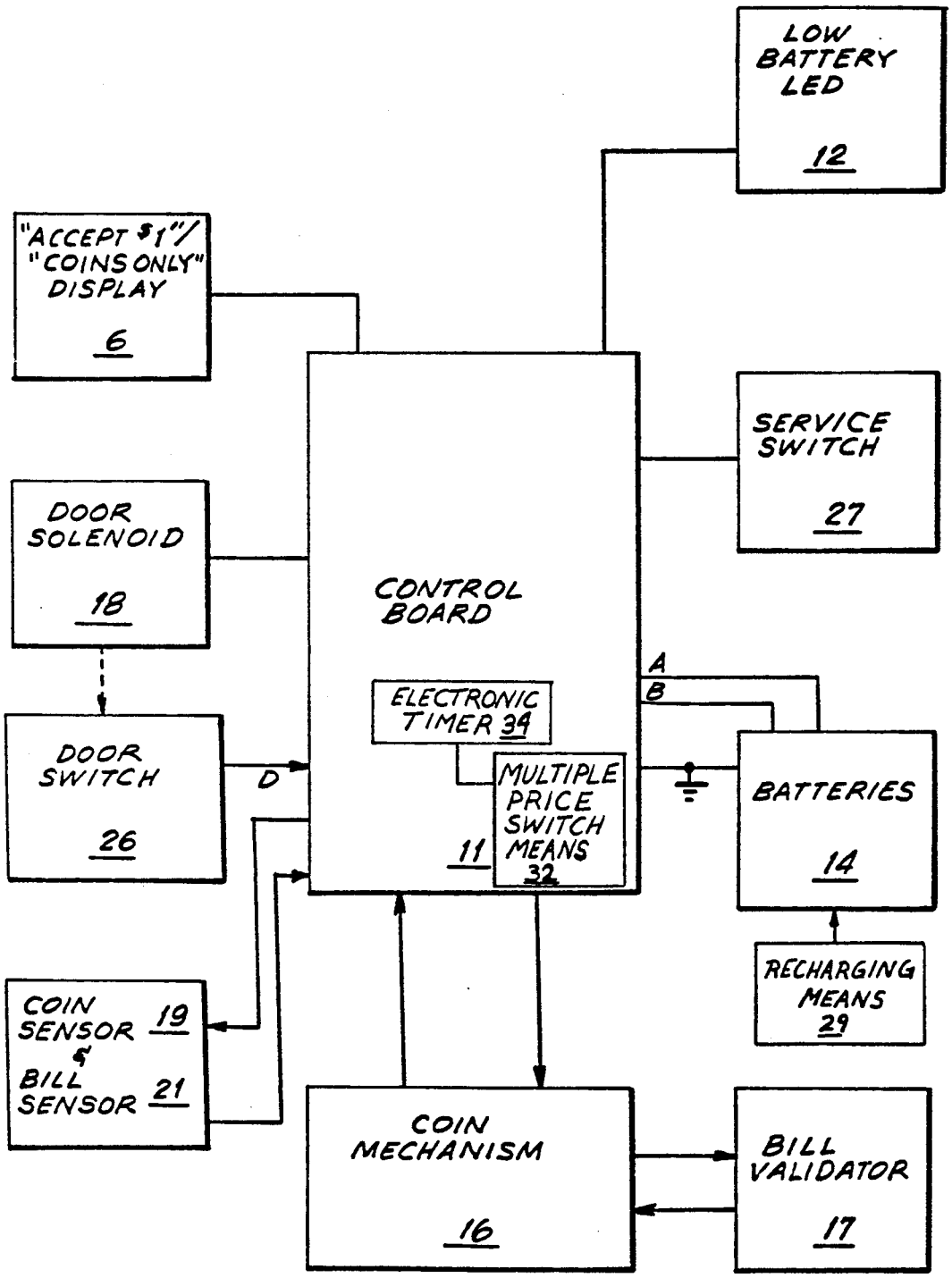
FIG. 6 is a block diagram showing the functions of the control board of FIG. 5, and also showing additional elements of the apparatus of FIG. 1.

FIG. 6 is a system block diagram which illustrates the interfacing of the Control Board 11 with the other system components and devices. The Control Board 11 not only provides power to the coin mechanism 16 and, thus, indirectly to the bill validator 17 (refer to FIG. 5), but it also serves to conserve power in the apparatus 1 by translating a vend pulse from the coin mechanism 16 to the door solenoid 18 in a power saving fashion, as will be described in further detail below.

When the door 2 of the apparatus 1 is opened, a door switch 26 senses this opened state and generates a signal, called a "blocker". When the vend signal is received by the Control Board 11 from the coin mechanism 16, the "blocker" signal is then passed from the door switch 26 to the coin mechanism 16.

Note that while the door switch 26, which is a mechanical switch, is presently used in the present invention, other techniques or means can be employed to sense door position and door closure and to generate the blocker signal. These well known alternative techniques or means include, but are not limited to, use of a magnet and reed switch, potentiometer, LVDT (Linear Variable Displacement Transducer), Hall effect device with magnet, Halleffect device rotational sensor, magnetoresistive sensor and magnet, tilt switch, optical encoder, optical interrupter, optical reflective sensor, capacitance, "g" (gravity) or mass switch, conductive plastic, ultrasonic, acoustical (standing wave), acoustical (contact), vibration, a coil and moving magnet, eddy current, flux gate magnetometer, strain gauge, DC motor, dynamo, vibrating arm, and ringing coil. The above listed alternative techniques or means for sensing door position and closure may be employed either individually or in combination with one another as appropriate.

In addition, there is a display 6 driven by the Control Board 11, which is employed to indicate whether dollar bills and coins can be accepted by the system or if the transactions must be accomplished by coins only. The display 6 in the preferred embodiment is a magnetic bistable element such as those manufactured by the Staver Company, Incorporated. The decision to accept dollar bills and coins or coins only is determined by monitoring the.level of coins in the coin storage tubes (not shown), which are located in the coin mechanism 16. Just prior to shutting down the system.(turning off or terminating the 20 second system operating timer 44 on the Control Board 11), the coin mechanism 16 does an internal check on the state of its coin storage tubes and decides whether dollar bills can be accepted or not. The Control Board 11 then checks the state of the display 6, as reflected in a memory element on the Control Board 11. If the coin mechanism 16 decision is not in agreement with what is currently being displayed by the display 6, the coin mechanism 16 provides a signal to change the state of the display 6. The memory means located on the Control Board 11 also drives the display 6. In the preferred embodiment, the display 6 displays one of two messages, namely "ACCEPT $1" or "COINS ONLY".

While the above operation is described as being performed at the end of each vend cycle, it may also just as easily be performed at the beginning of each vend cycle.

The display element 6 utilizes a cylindrical structure on which the display legend is placed. The magnetic bistable display element 6 will retain its state with no power required, which is advantageous in that the apparatus of the present invention utilizes very little power and the control system is in the low-power or nap mode most of the time.

The circuitry located on Control Board 11 also comprises means to test for and indicate whether the battery voltage is low. It is important to be able to detect low battery power while there is still sufficient energy remaining in the system's batteries 14 so as to allow for a period of satisfactory operation until a battery replacement can be made. When a low state of the batteries 14 has been detected by the circuitry on the Control Board 11, a LOW BATTERY LED D28 (refer to FIG. 3) is illuminated subject to the following conditions: Energy must be conserved by the control system in activating the LOW BATTERY LED D28 since constant illumination of such will only exacerbate the low-power problem. The LOW BATTERY LED D28 is only illuminated when a vend is made or when the service switch 27 is activated. The service switch 27 simply provides an indication that the apparatus 1 is being refilled with items or if some other service task is being performed on it. In this manner, the LOW BATTERY LED D28 is illuminated only when a person is in the vicinity of the apparatus. Hence, power is conserved in this manner.

Various means are used to keep the average power consumed by the Control Board 11 and the peripherals very low, while still enabling the apparatus 1 to be responsive to a user vend request. At such time as a vend request, the control system transitions from a low-powered nap mode to a full-powered or wake-up state or mode. This wake-up mode is initiated by the insertion of either a coin or a bill. While a coin or bill is the usual anticipated means by which the user may initiate operation and hence make a purchase, the apparatus of the present invention may also be designed to operate via use of any kind of money which term has been defined to include credit card, value card, token, coupon, or other cash alternative. Further, the presence of the user or potential user may be detected or sensed by his juxtaposition to the vending machine so as to drive the system from a nap mode to a wake-up mode. This may be accomplished by the use of ultrasonics, light, pressure, or other means. Further, the control system operation is transparent, and hence unnoticeable, to the user who is utilizing the vending apparatus. Certain actions may be required by the user in certain embodiments to initiate the operation of the vending apparatus. Further, the wake-up of the system occurs in such a way so as not to interfere with the normal vending operation of the apparatus. Hence, the result is a battery-powered vending apparatus having a control system which is capable of low-powered "nap" operation when the vending apparatus is not in use and a full-powered "wake-up" operation when it is in use, with the transitioning from one state to the other undetectable to the user and undetected in the operation of the vending apparatus. The control system of the apparatus of the present invention further has the capability to perform an energy audit. The status representing the result of the energy audit is used to set an external indicator which displays such.

Hardware is further provided on the Control Board 11 to keep the power supplied to the door vend solenoid 18 to a minimum. This hardware will be described in more detail below.

The door vend solenoid 18, a component of the product delivery means, when activated, facilitates the removal of the newspaper or other printed matter from the vending apparatus. While the product delivery means of the present invention is a door release mechanism utilizing a simple electromagnetic solenoid (door vend solenoid 18), other means of securing and then selectively releasing a vending door or other product delivery means could also be employed. These well known alternative means include, but are not limited to, a mechanical "flip-flop" with alternating release and latch coils, a latching solenoid or relay, shape memory metal, a rotating motor driven latch, a linear motor driven latch, and latches or releases that use either pneumatic, hydraulic, or electrophoresis means in their operation. The alternative means for activating or releasing a product delivery means may be used either individually or in combination with one another as appropriate.

After the vending cycle is completed, with change being provided, if appropriate, the system automatically turns itself off and returns to the nap mode. This technique allows operation of the apparatus 1 from compact battery power sources for months of daily operation without supplemental charging. If supplemental charging means are implemented, the operating life of the apparatus on a given set of batteries can obviously be extended even further. The battery-powered system of the present invention conserves power and is energy efficient and can operate for months without recharging or having to be directly connected to a line voltage source. For example, with respect to the apparatus 1, the daily vending of 30 newspapers for a two-month period can easily be performed utilizing only one set of batteries 14. Further, as described earlier, apparatus 1 and the associated control system utilize a magnetic bistable element display 6 so as to display to a user the ability of the system to either accept bills and coins (such as where sufficient coins exist in the dispenser to make change) or to accept coins only (where insufficient coins exist in the coin storage tube).

The sensors 19 and 21 placed on the coin chute 5 as shown in FIG. 4 and in the bill snout 20, respectively, are activated briefly from 2 to 50 times a second for sensing the presence of a coin or bill in the respective chute or snout. When a coin or bill has been inserted the control system goes into operation as will be described below. During other periods, where neither a coin nor a bill is sensed, current is maintained at a very low level since only the background sensing timer is active. This is the nap mode of system operation.

Typically, this background current present in the system during the nap mode is on the average in the range of 100 to 200 $\mu$a. Other power conservation techniques could be employed to permit background currents to extend down considerably below 100 $\mu$a if slower sampling of the insertion ports (i.e. coin chute 5 or bill insert slot 7) is desired or if a CMOS microprocessor might be considered for use in such an application.

FIG. 7 is a detailed block schematic diagram of the Control Board 11 depicting its circuitry as well as its interfacing with the system peripherals. As mentioned earlier, the coin mechanism 16 and the bill validator 17 are well-known in the prior art, and the operation and function of those devices will only be described as they relate to the operation of the apparatus of the present invention. The details of the coin-mechanism 16 and the bill validator 17 do not form part of the present invention.

The circuitry and functioning of the Control Board 11 will now be described.

CONTROL BOARD FUNCTIONS

Background Timer

Figure 7A:
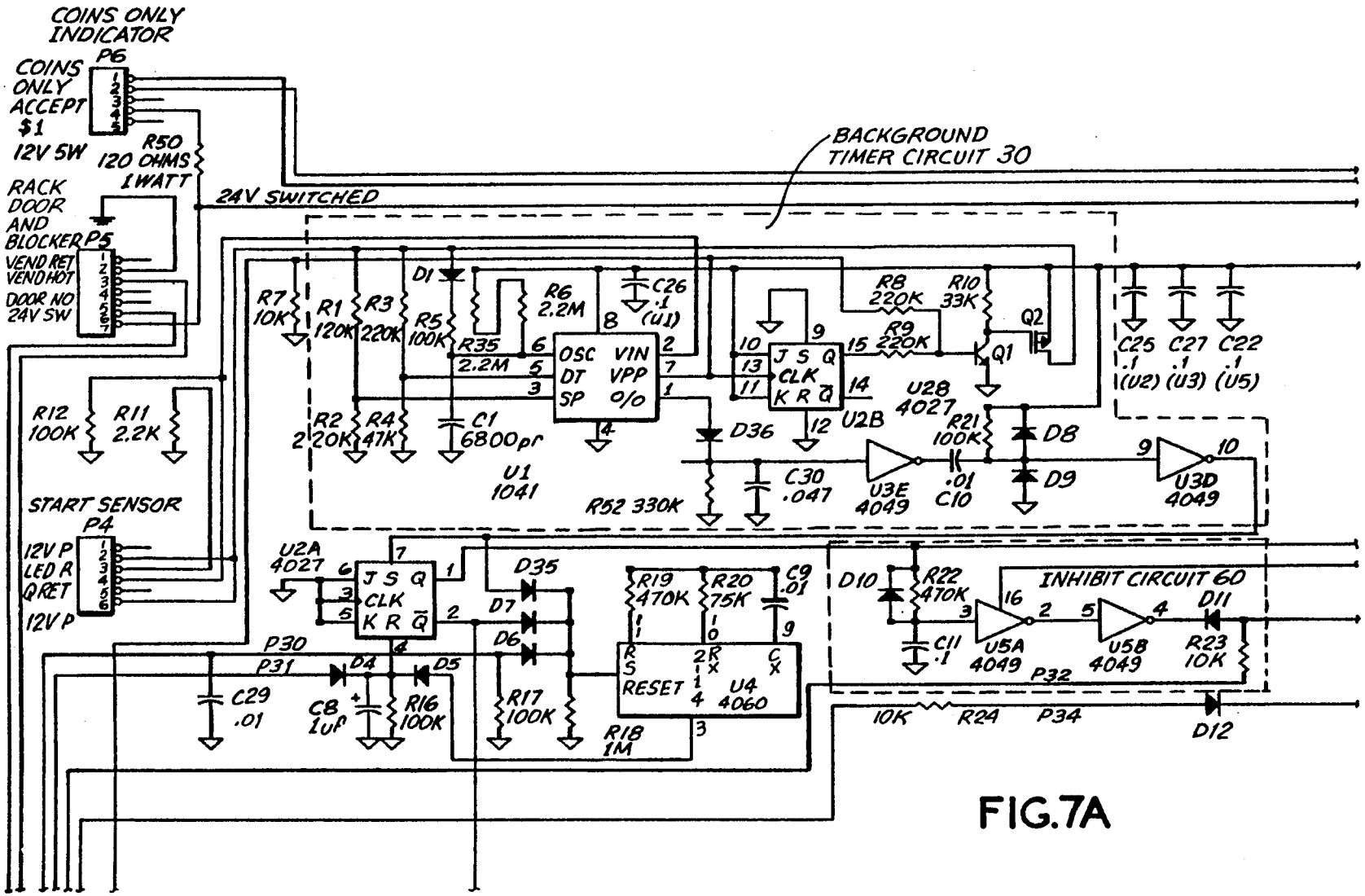
FIGS. 7A–7D comprise a detailed circuit schematic diagram of a control board employed in the apparatus of FIG. 1.

The Control Board 11, utilizes a background timer circuit 30 denoted in FIG. 7A. The background timer circuit 30 is built around a controller U1, such as an LTC1041 Bang-Bang Controller produced by Linear Technology Corporation. This background timer 30 is powered at all times. However, in its background mode, it typically consumes under 10$\mu$a. At the end of a predetermined background timing cycle, which will be described in more detail below, the controller U1 sets a JK flip-flop U2B. The JK flip-flop may be a Model CD4027 produced by National Semiconductor. The setting of JK flip-flop U2B turns on transistors Q1 and Q2 which apply power to the sensing circuitry located inside the coin chute 15 and bill insert slot 7, namely, the coin wake-up sensor 19 and the bill sensor 21. Typically, this activation of the aforementioned coin and bill sensors requires a current of approximately 5 ma. During this sensor sampling time interval, coin or bill presence is determined. If neither a coin nor a bill is present, flip-flop U2B is reset and transistors Q1 and Q2 are turned off and the current drops to under the 10 $\mu$a background level. The sensor sampling rate can range from 2 to 50 times per second, with 12 times a second being the rate utilized in the preferred embodiment.

Hence, a low power sensor sampling operation is performed during the "nap" mode to determine if a coin or bill is present in the apparatus 1. Sampling periods can be chosen depending upon the amount of power desired to be utilized in such operation, which depends on the denomination of the coin or bill to be utilized. Further, the sensor sampling rate may be determined by circuit design using conventional components.

In the background timer circuitry 30 of Control Board 11 (shown in FIG. 7A), the sensor sampling rate or period is determined by resistors R6 and R35 as they operate in conjunction with capacitor C1. This resistive/capacitive network is connected to the oscillator input pin, pin 6, of controller U1. While resistive and capacitive elements may be determined previously and placed into the circuitry, it is also envisioned that variable resistive elements such as potentiometers and rheostats, or variable capacitive elements may be utilized so as to afford means whereby on-site sensor sampling rate adjustments or modifications may be made so as to avoid having to take the vending apparatus out of service entirely.

When the voltage on capacitor Cl approaches approximately 90% of that voltage present on the supply pin, pin 8, of the controller U1, the controller output pin, pin 7, also known as Vpp, goes high. Vpp is switched high for a period sufficient to make a sampling measurement after which it goes low again. The high-to-low transition of the signal from Vpp, line 7 of controller U1, occurs whenever the timing cycle is complete. This Vpp signal is fed to JK flip-flop U2B. Each successive low-to-high (positive edge) transition forces flip-flop U2B to complement its output state. The use of flip-flop U2B essentially operates as a pulse stretcher which stretches the Vpp output signal from controller U1, and therefore allows for the holding on of transistors Q1 and Q2 for a duration longer than the actual Vpp pulse period.

Assume for example that the Q output, pin 15, of the flip-flop U2B has just gone high. Transistor Q1 is turned on which forces the gate of transistor Q2 low and, therefore, turning Q2 on. This action causes power to be applied to the sensors in the track of the coin chute 15 or bill snout 20 via connector P4, pins 2 and 6.

The return LED current from the coin or bill sensors, 19 and 21 respectively, is provided by resistor R11. Additionally, FIG. 7E denotes a circuit diagram of the coin and bill sensors as they connect with the circuitry of FIG. 7A–7D. The coin wake-up sensor 19 and the bill sensor 21 are comprised of optoisolators 31 and 32, respectively. The current which flows through resistor R12 is dependent on the logical ANDing of the light induced current produced by the optoisolator sensor circuits 31 and 32. The light induced current is generated from the light passing from the LED 90, 92 to the phototransistor 91, 93 of each optoisolator circuit 31, 32 for each of the coin and bill sensors, respectively. Thus, the voltage produced across resistor R12 is light dependent. Therefore, either a coin or bill that occludes the light in either the coin or bill sensor will cause a reduction of light in that particular sensor. This reduction of light causes a reduction in current and a resulting reduction in the voltage developed across resistor R12.

Returning once again to the background timer circuitry shown in FIG. 7A, the turning on of transistor Q2 also forces the common end of resistors R1 and R3 high. Resistors R1 and R2 determine the set point voltage for, and which is applied to, controller U1 at pin 3. The set point voltage is the predetermined operating voltage of the controller U1.

Resistors R3 and R4, which are connected to pin 5 of controller U1, determine the amount that the input voltage on pin 2 of said controller may vary from that applied to pin 3 before the output of pin 1 of the controller U1 will change state. The voltage input to controller U1 is obtained from current flowing through the optical sensor output and through resistor R12. This results in a voltage drop across resistor R12 which is applied to pin 2 of the controller U1. Typically, this voltage developed across resistor R12 and applied to pin 2 of controller U1 is 10 volts or greater.

If a coin or bill occludes the light in either of the optical sensors 19 or 21, reduced current will flow through resistor R12 and, therefore, the voltage at the upper end of R12 will be much lower, typically less then 2V. When this occurs, the output pin 1 of controller U1 will go high. This causes, via the action of inverters U3E and U3D, the signal present at the "Set" pin, pin 7, of JK WAKE-UP flip-flop U2A to go high. This action forces the output Q of WAKE-UP flip-flop U2A to go high so as to initiate a power up of the coin mechanism 16 and the bill validator 17. Flip-flop U2A is known as the WAKE-UP flip-flop. Capacitor C10 and resistor R21 will allow only the edge information from the output of inverter U3E to change the state of WAKE-UP flip-flop U2A. This design scheme prevents a bill or coin jam which could hold the output of inverter U3E low and, therefore, force the power to stay on in the associated circuitry. This activity would eventually run down the batteries and is undesirable. Diodes D8 and D9 act to clamp and protect the input signal present at the input of inverter U3D.

While the means by which to sense the presence of a coin or bill and, hence, wake up the system, utilized in the preferred embodiment has been accomplished by an optical transmission technique, such is merely one embodiment of the present invention as other sensing means may also be employed. Further, the means used may be different for coins or for bills. These well known alternative sensing means include, but are not limited to, sensing a bill using a tilt switch, optical reflectance, capacitance, low load contact switch, dynamo, DC motor, optical encoder, displacement or rotation via a magnet and pickup coil, fiber optic internal reflectance, or acoustical reflectance. These methods can be used either individually or in combination with one another as appropriate.

Other means for sensing coins include, but are not limited to, means utilizing a switch contact, impact, acoustical, eddy current, optical reflectance, ringing coil, or magnetoresistive element with a magnet. These well known alternative sensing means can be used either individually or in combination with one another as appropriate.

Additional means also exist and may be employed for waking up the vending apparatus other than by coins or bills or other cash alternatives. These well known alternative methods include, but are not limited to, active means in which the user must perform specific actions and passive means which require no activity by the user. Active means might include lifting, depressing, rotating, or changing the position of a panel/door or depressing a button or switch. Passive means of sensing the presence of a user might include optical reflectance, acoustical reflectance, an interrupted light beam, a long wavelength measure of body heat, distortion of a mat or carpet which is placed in front of the machine, vibrations from footfalls of the user, electrostatic discharge of a panel potential, distortion of an electrostatic field near the front of the machine, change in air currents near the machine, or the use of strain gauges. These well known alternative means also can be used either individually or in combination with one another as appropriate.

The input voltage, Vin, at pin 2 of controller U1 must be stable 4 microseconds after the beginning of the signal comparison so that an accurate comparison of Vin at pin 2 against the set point voltage (present at pin 3) can be made. However, this is not possible since the rise of the voltage at Vin, pin 2, is determined by the phototransistors and any stray capacitance associated with them, and is subsequently slow in arriving at its final rest state. Thus, this first timing pulse of the pair generated by the controller U1 is useless, and is therefore viewed as a dummy signal.

It is important to note that transistors Q1 and Q2 are held on independent of the state of Vpp, pin 7, of the controller U1 since the Q output, pin 15, of flip-flop U2B was driven high. When transistor Q2 is turned on by transistor Q1 the anode end of diode D1 is then driven to 12 volts.

There are two timing periods associated with the operation of the background timer circuit 30. One timing period is a short one, and the other timing period is a long one. These timing periods repeat alternately as long as battery power is applied to the Control Board 11. Typically, a value for the long timing period is 80 ms while a value for the short timing period is 3 ms. Each timing period is initiated by a timing pulse which appears on the Vpp pin output, pin 7, of controller U1 as a positive output pulse. Each timing pulse, which initiates a timing period, is indicative that a comparison of Vin to the Set Point voltage is in progress. The first timing period is a dummy and is used to power up the sensors 19 and 21 in anticipation of the second timing period which will enable a valid comparison since the sensors 19 and 21 and the voltages produced by each have had ample time to become stable. This is accomplished in the following fashion. The first timing pulse which initiates the first timing period is generated by the resistor/capacitor (RC) combination of resistors R6 and R35 in conjunction with capacitor C1. When the voltage at the OSC pin, pin 6, of controller U1 reaches the upper threshold voltage, the Vpp pin, pin 7, of controller U1 is driven high and remains in this state for approximately 60 to 100 microseconds during the comparison process. This first timing pulse applies power to the sensors 19 and 21 via resistor R8 and also causes the output state of JK flip-flop U2B to change. This first timing pulse will cause Q output, pin 15, of flip-flop U2B to go high which will cause transistors Q1 and Q2 to be held on after this first timing pulse disappears. Resistor R9 ensures that transistors Q1 and Q2 are held on after the timing pulse disappears. Note that the output, pin 1, of controller U1 may or may not change. Further, the output of controller U1 may or may not follow the state produced by the second timing pulse. This temporary state during the first timing period is ignored so that the system does not respond to measurement during this dummy timing period. This action of disregarding the first timing period and its associated measurements is accomplished by diode D36, resistor R52, and capacitor C30 in a manner which will be explained in more detail below.

When transistors Q1 and Q2 are turned on, the anode end of diode D1 is connected to the 12 V SWITCHED line. This causes, at the completion of the first timing pulse, after Vpp has gone low and capacitor C1 has been discharged via the internal action of the LTC1041, capacitor C1 to be charged by the action of diode D1 and resistor R5. This action causes, after capacitor C1 is charged to the high trigger level of controller U1, a second timing pulse to be generated, indicating that another comparison is in progress. This activity is indicated by Vpp, pin 7, of controller U1 going high again. When the Vpp pin, pin 7, of controller U1 goes high again, the Q output, pin 15, of flip-flop U2B goes from high to low. This transition by flip-flop U2B removes the flow of current through resistor R9 to transistor Q1 so as to hold it in the on state. However, transistor Q1 is still held in the on state by the action of Vpp, pin 7, of controller U1 through resistor R8 which supplies enough current to hold transistor Q1 on as long as Vpp stays high. This second measurement operation is accurate since the sensors 19 and 21 in the coin mechanism 16 and bill validator 17, respectively, have been activated sufficiently long enough to have stabilized (they have been powered since Vpp went high as the first timing pulse). During the second timing pulse, the output pin, pin 1, of controller U1 will assume its correct state. If there is no bill or coin detected during this timing period, then pin 1 of controller U1 will remain low and the WAKE-UP flip-flop U2A will not be set. However, if a bill or coin should be detected, then pin 1 of controller U1 will go high. The logic level present at pin 1 of controller U1 will be transmitted via the action of diode D36, resistor R52, and capacitor C30, as well as inverters U3E and U3D in conjunction with capacitor C10 and resistor R21, to the SET pin, pin 7, of the WAKE-UP flip-flop U2A thereby making its Q output at pin 1 go high. This action will cause a wake-up cycle to be initiated.

Since the timing pulse that signifies the beginning of the second timing period will be followed by a long delay until the recurrence of the first timing pulse which initiates the repeating first, dummy timing period, the signal level at the input, pin 11, of inverter U3E will be influenced much more by the state of the output, pin 1, of controller U1 during this period than during the relatively short period between the first and second timing pulses. Resistor R52 and capacitor C30 are selected to ignore the output state of controller U1 during this brief first timing period and, further, only to respond to the output of controller U1 during the longer second period which occurs between the end of the second timing pulse and continues up until when the dummy or the first timing period occurs again. Diode D36 prevents the state of the output, pin 1, of controller U1 from changing the voltage level on capacitor C30 which is maintained during this longer time.

At the completion of the first (or short) timing period, Vpp, pin 7, of the controller U1 will pulse once again, forcing the JK flip-flop U2B to complement its output state at pin 15 and will cause it to go low. Flip-flop U2B is also typically a Model CD4027 JF flip-flop produced by National Semiconductor. The transition of the output, pin 15, of flip-flop U2B to a low state causes transistors Q1 and Q2 to turn off, after Vpp, pin 7, of controller U1, the second timing pulse has gone low at which time the system lapses back to its low powered or nap state.

When the presence of a coin or bill is detected during one of the brief periods of system alertness or sensor sampling or strobing which occurs during the short timing period, which are typically 3 milliseconds or less in duration, the WAKE-UP flip-flop U2A, is set. The setting of WAKE--UP flip--flop U2A enables a 20 second timer U4 which employs a counter such as a Model CD4060 14 Stage Ripple Carry Binary Controller produced by National Semiconductor. The 20 second timer is the system operational timer which provides that the Control Board 11 and the various peripheral devices, i.e. coin mechanism 16 and bill validator 17, will be powered for a time period sufficient to allow the completion of the vending operation. The 20 second timer is also utilized at the end of the vending operation so as to allow the system to be powered up for a time period sufficient to allow for the return of any change due the user. WAKE-UP flip-flop U2A can be cleared or reset by the coin mechanism 16 when payout of coins has been completed, thereby placing the control system back into the nap mode and reducing the total power consumption. The WAKE-UP flip-flop U2A could also be cleared or reset at the end of any other cycle. Further, the count in the 20 second timer U4 can be cleared, extending the total powered up time for as long as is desired when either an abandoned vend has occurred, a long delay has occurred before blocker breaks (the vending apparatus door 2 is opened), or prior to paying out change.

It should be noted that the vending apparatus door 2 must be opened for a specific period of time (such as 1.2 seconds) before the 20 second timer is cleared. Otherwise, the user could lose his money if the door slips out of his hand and closes before he or she takes the newspaper or other item from the interior of the apparatus. This feature of the present invention promotes good will and good public relations between users and the suppliers who utilize these vending machines.

If the 20 second timer U4 is not cleared, then at the end of the 20 seconds, when U4 times out, it will cause WAKE-UP flip-flop U2A to be reset which forces the control system back into the nap mode. In some instances this could accept coins or bills from the user without allowing the user access to the newspaper. This occurs when a user inserts some coins and needs to search for more to meet the vend price. Means are provided to prevent such an occurrence in the present invention. Diode D35 is used to reset this timer U4 whenever a coin or bill is inserted into the vending apparatus so as to ensure that the 20 second timing interval begins upon the successful receipt of the last valid coin or bill. Note that a bill which is repeatedly rejected may be lost to the user without this diode D35 being in place. Here again, the present invention promotes good will and good public relations.

Figure 7B:
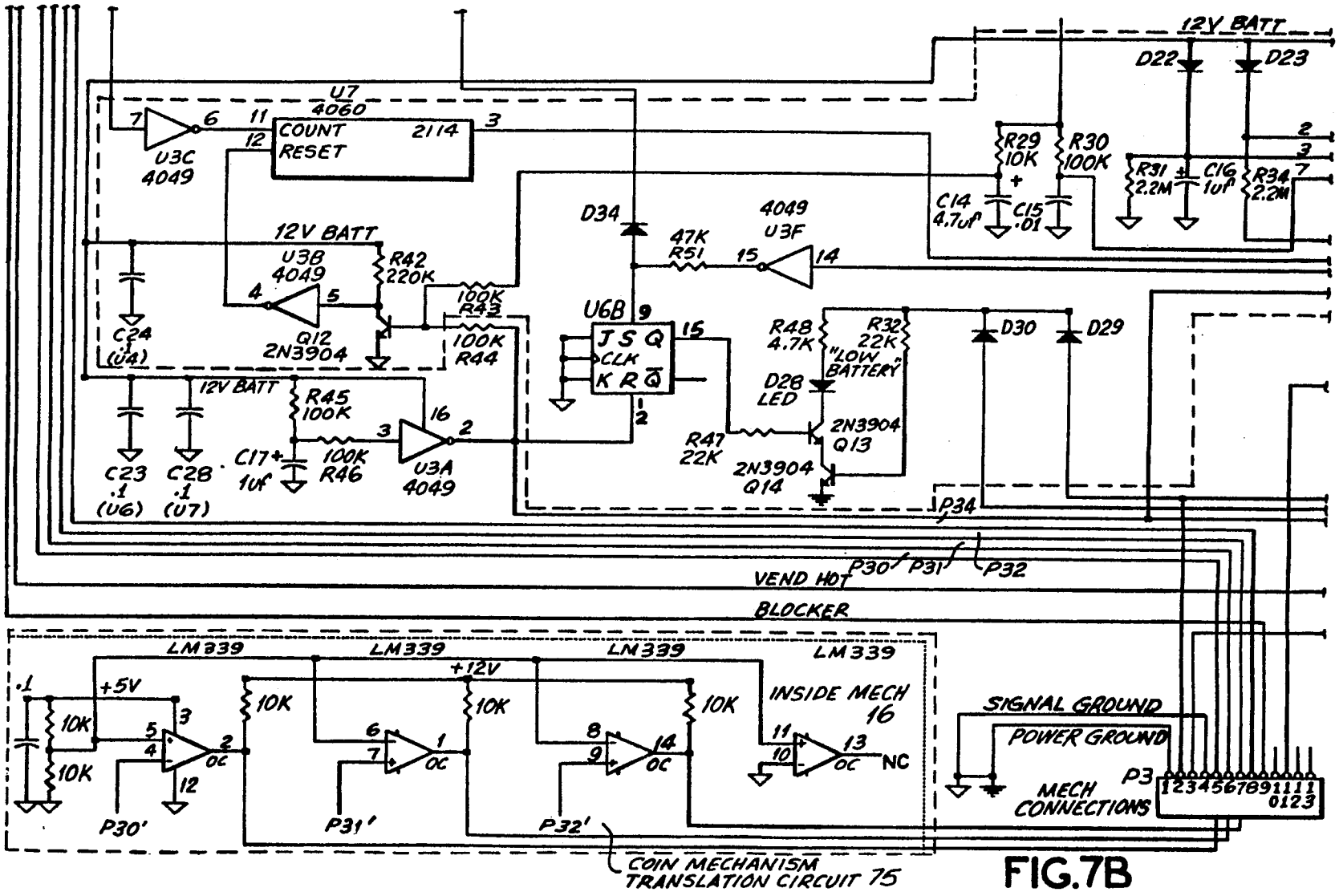
Figure 7C:
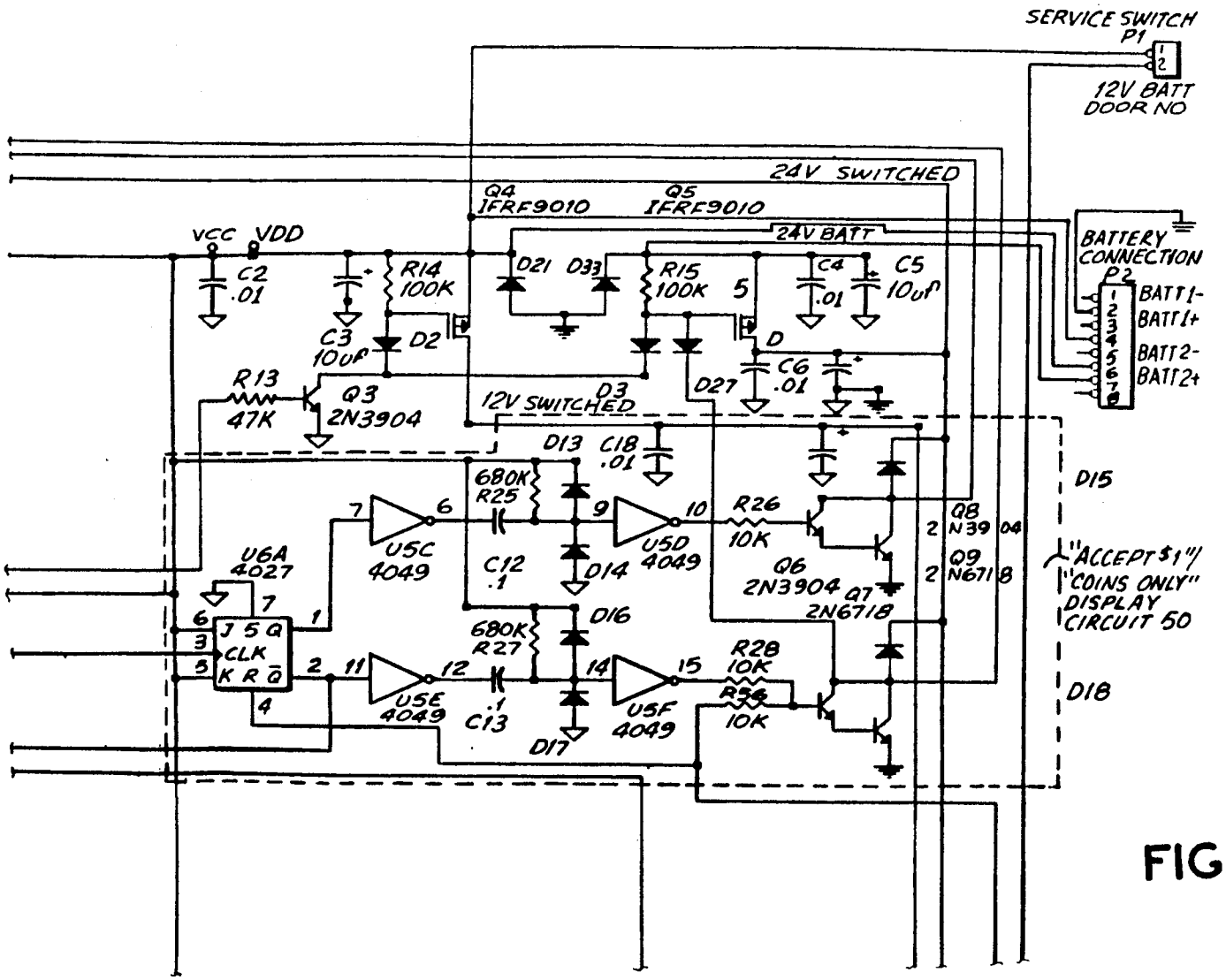

Referring to FIGS. 7A and 7C, when the WAKE-UP flip-flop U2A is set (Q output at pin i is high), transistors Q4 and Q5 are turned on by transistor Q3 and battery power from batteries 14 are applied to both the coin mechanism 16 and the bill validator 17.

Upon the turning on of transistors Q4 and Q5, two voltages are switched on. One is from a 12 volt battery while the second is a 24 volt operating voltage which is obtained by placing two 12 volt batteries in series with one another. Only two 12 volt batteries 14 are employed in the preferred embodiment of the apparatus of the present invention.

Power is obtained from one 12 volt battery for peripherals requiring 12 volts DC, while 24 volt DC power is obtained from the series connection of the two 12 volt batteries for those components requiring a 24 volt DC supply. Note that it is the coin mechanism 16 which requires 24 volt DC operating solenoids and dispensers, thereby requiring the 24 volt DC operating voltage. Different DC voltage potentials may be required or used in other embodiments depending upon the requirements of the devices employed therein. A single battery or more than two batteries, may be used in the present invention, depending upon the requirements of the system and the space available in the apparatus. Further, switching voltage supplies may be used to generate one or more of these voltages from a power source such as a battery which may be different in voltage from that needed or required.

The batteries 14, supply power to the coin mechanism 16 and to the bill validator 17, which then become active. These power supply voltages will remain active until either one of two events occurs. If the coin mechanism 16 completes its operation and pays out coins, it may reset WAKE-UP flip-flop U2A, which will turn off the 20 second timer U4 and switch off transistor Q3. The switching off of transistor Q3 will turn off transistors Q4 and Q5 thereby removing the 12 volt and 24 volt DC power sources from the coin mechanism 16, and the bill validator 17. Alternately, if the 20 second timer U4 times out, its output, pin 3, will go high thereby resetting the WAKE-UP flip-flop U2A and causing the turning off of transistors Q3, Q4, and Q5 resulting in the removal of the 12 volt and 24 volt DC power sources to the coin mechanism 16 and the bill validator 17. The scheme again saves energy that would otherwise be lost. This results from the switching of the system off when the last of the system's required tasks have been completed.

Low Battery Indication

It is important to determine how much energy is remaining in the batteries 14 during system operation.

Battery end voltage, which refers to the change in the terminal voltage of the battery as it approaches the end of the period during which it can effectively supply energy to an external load and which decreases over time due to internal battery chemical activity, is an indication of energy storage. Battery end voltage, however, is very age, temperature and environmentally dependent. As a result, an absolute voltage (a simple terminal voltage measurement) is an inadequate measure of the energy remaining in the batteries 14.

The technique employed by the present invention, in measuring the energy remaining in the batteries 14, is to place, briefly, a heavy test load resistor R39 (see FIG. 7D) on the battery 14 and to note how much the battery terminal voltage changes. If this change in the battery voltage (delta voltage) is greater than or equal to a predetermined limit, then it is time to change the batteries 14. Variation in the battery terminal voltage, which may be caused by age, temperature, or any other type of environmental modifier, is therefore either reduced or eliminated from the measurement. The aforementioned predetermined delta voltage may be selected so as to provide for a desired remaining battery capacity. This is desired in order to determine when the battery energy level is low well in advance of that point in time when the apparatus would cease to be operational because of lack of power. A vending apparatus which ceases to operate with no warning at all to the user could result in a loss of good will and poor public relations. By selecting a delta voltage for a desired remaining battery capacity, one can ensure a low battery power indication well in advance of total battery failure.

The present method of testing the amount of energy remaining in the batteries is also known as a pulse load method which looks at the change in battery terminal voltage before and after the load has been applied or "pulsed" on the batteries. There are other techniques or methods which also could be used to measure the supply of electrical energy either available to the apparatus components or which has been already expended. Some of these well known techniques or methods are battery type specific and include, but are not limited to, measuring the total battery voltage (with or without temperature compensation), measuring the specific gravity level of the electrolyte, measuring the battery temperature rise under a known load, counting the number of power events and their budgets, use of a Curtis electrochemical timer to integrate power drain, comparison of battery voltage using a A/D converter against a stock template table or against an earlier measurement generated using the same battery which may be stored in a number of various means, supplying a known amount of energy to the battery and looking at the increase in battery voltage, measuring the rate of change of battery voltage before the final equilibrium value is attained under a test load, or measuring AC impedance vs. frequency of the excitation. These methods may be used either individually or in combination with one another as appropriate.

In some cases, the test load can be the actual load, such as the coin mechanism 16, the bill validator 17, and the vending door solenoid 18. However, applying power to the vending door solenoid 18 could lead to operational repercussions in that, when the vending door solenoid 18 is used as a load, current is applied to the solenoid and items could be removed from the vending apparatus without the user having to pay for them. An alternate approach is to apply power only to the coin mechanism 16 and the bill validator 17, and to extrapolate the resulting measurement to the heavier load produced by applying current to the coin mechanism 16, the bill validator 17, and the door solenoid 18 all at once.

Figure 7D:
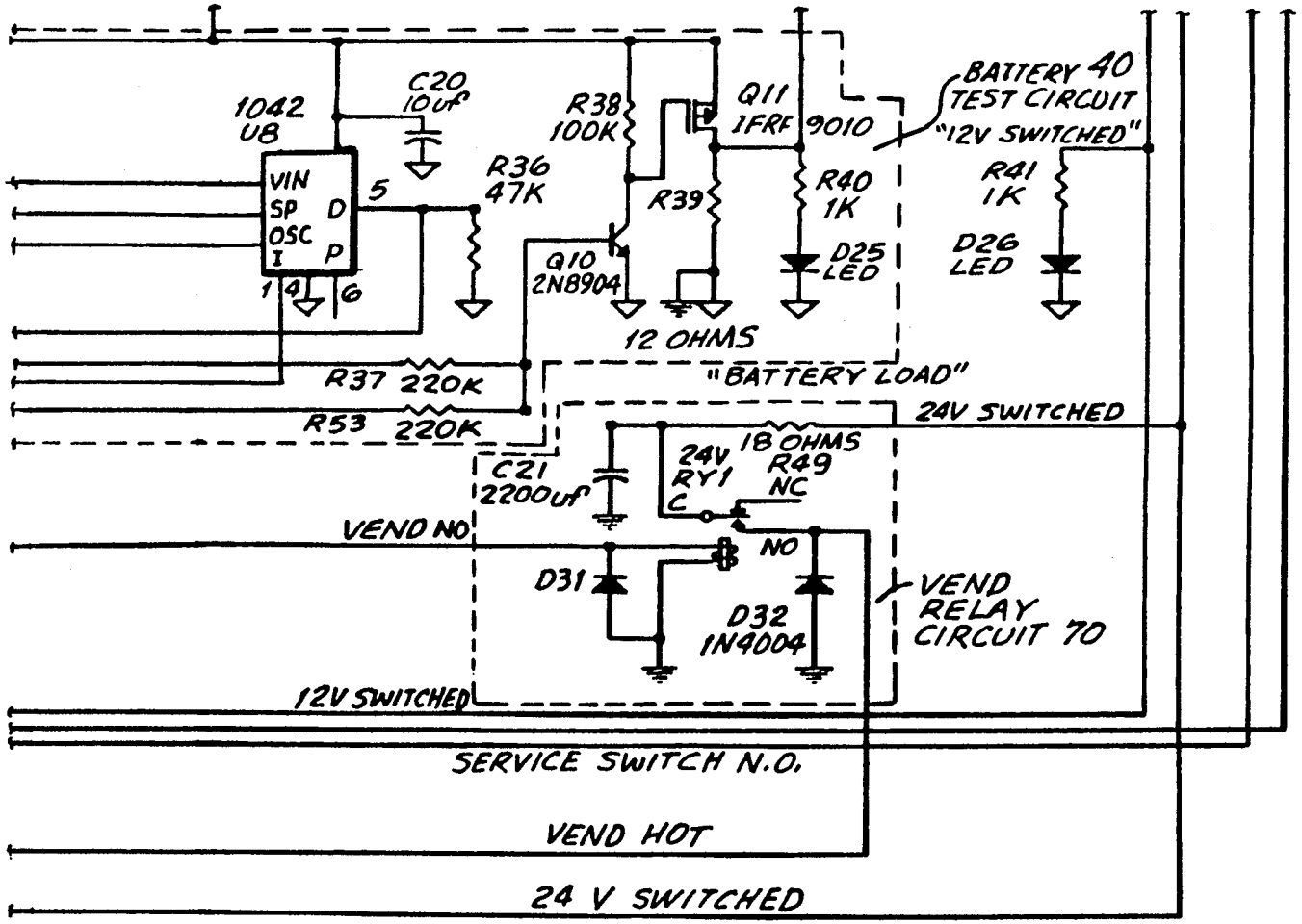
Figure 7E:
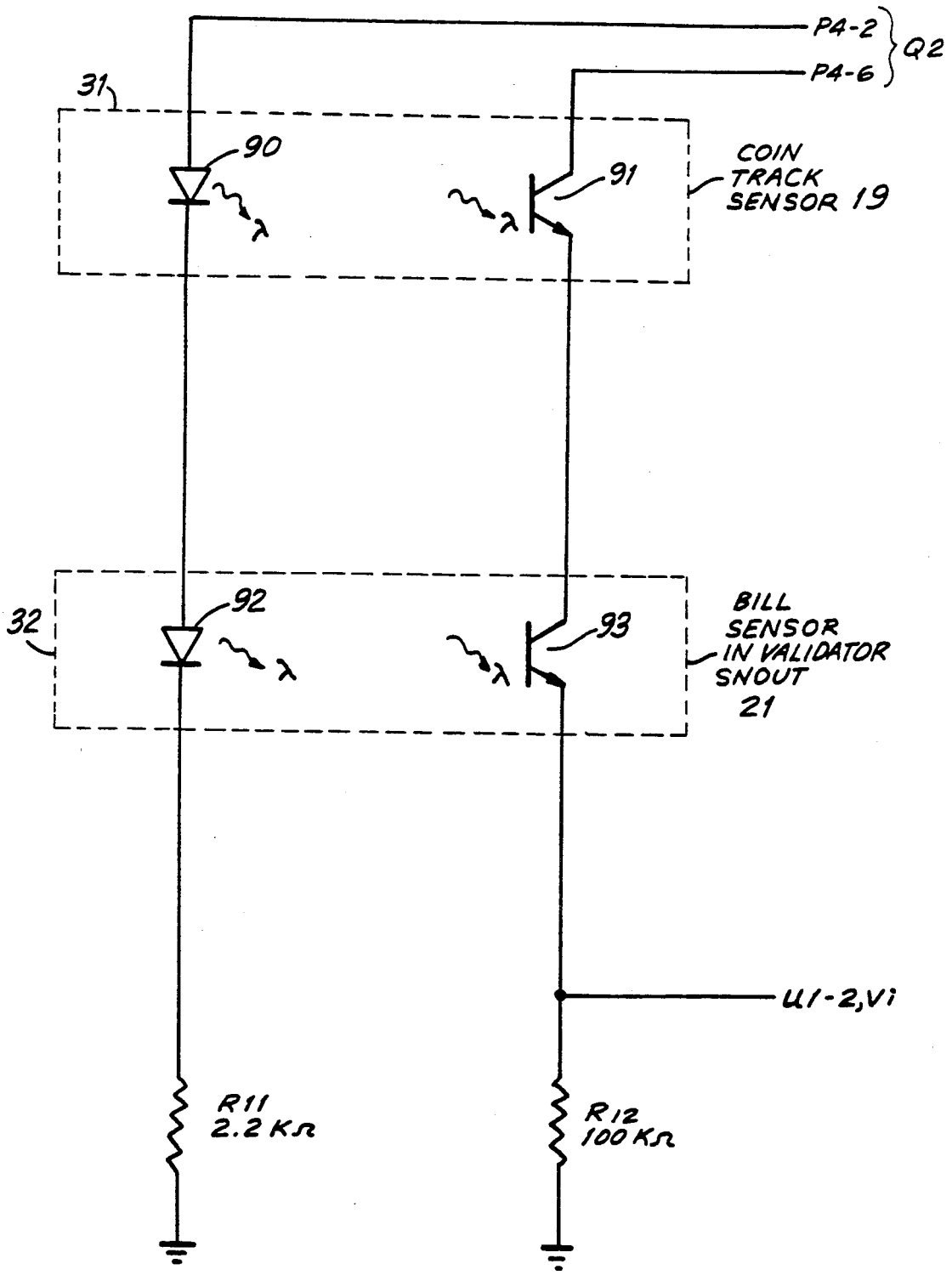
FIG. 7E is a circuit diagram showing the manner of connection between the coin and bill sensors of FIG. 5 and the circuitry of FIGS. 7A–7D.

Referring to FIGS. 7B and 7D, the battery test circuit 40 may be described in its preferred embodiment. The battery test circuit 40 utilizes the background timer circuit 30 (controller U1) to provide 12 pulses/second which are monitored and counted by counter U7 which is typically a Model CD4060 14 Stage Ripple Carry Binary Counter produced by National Semiconductor. When 8,192 ($=2^{13}$) of these pulses have been counted, which translates to a time interval of approximately 11 minutes, the output, pin 3, of counter U7 will go high. When the output of Counter U7 goes high, transistors Q10 and Q11 turn on and connect the 12 ohm test load provided by resistor R39 to the 12 Volt Battery 14, thereby causing a 1 amp drain to be placed on the battery 14. Capacitor C16 is charged to a pretest load battery voltage via diode D22.

Diode D22 is utilized in the circuitry so that the pretest voltage on capacitor C16 is not affected by the application of the resistive load of resistor R39. In this manner, a reference voltage is established across capacitor C16. The voltage across capacitor C16 is the preload battery voltage which is applied to pin 3 of Window Comparator U8 which is an LTC 1042 Window Comparator produced by Linear Technology Corporation. Although the voltage across capacitor C16 discharges in time through resistor R31 which is connected in parallel with C16, the RC time constant is on the order of seconds and, therefore, during the few milliseconds necessary to complete the required measurement, the decrease in voltage across capacitor C16, due to leakage, can be ignored since this change is acceptably small. The presence of resistor R31 in the circuit is important since the leakage from Window Comparator U8 could cause the voltage across capacitor C16 to be adversely affected thereby distorting the measurement.

The battery terminal voltage with the load of resistor R39 on it is applied to pin 2 of Window Comparator U8, via diode D23 and the resistor string consisting of resistors R34 and R36. Diode D23 is utilized to compensate for the voltage drop produced by Diode D22.

The voltage on the Window Comparator U8 on pin 2 minus the voltage on pin 5 is compared against that on pin 3. If the original unloaded pretest battery voltage, minus some predetermined voltage drop, is greater than the loaded battery voltage, then the battery has sufficient energy left therein for continued safe operation.

As noted before, a 1 amp current is flowing through resistor R39 when a battery power test is in progress. However, any operation which depends upon high current is susceptible to errors produced by resistances in those circuits which carry the current. In this instance, diligence is required to keep contact resistance low in the contacts located on the battery terminals, fuses, fuses sockets, and leads as well as any connectors which are used in conjunction with the batteries 14. This contact resistance is fixed in time and can be compensated for by circuit design techniques. Any error produced by this contact resistance must be taken into account when deciding upon the delta voltage referred to above. This will cause the delta voltage value to be increased so as to compensate for the voltage drops generated across these contact resistances. In the present invention, the sum total of these contact resistances is typically under 100 mΩ. Further designs could utilize techniques such as four wire techniques which are used to compensate for lead or contact resistance in high current applications and which would obviate the need for such delta voltage compensation and would reduce the error produced by such currents.

This drop in the voltage at pin 5 is about 0.235 volts, with this value selected for a normal operating voltage of 12 volts. If the loaded battery drops more than 0.235 volts from its unloaded state, then there is 20% or less energy remaining in the battery, and it is time to set the change battery flag. The actual comparison of the two voltages described above (the voltages at pin 2 minus the voltage at pin 5 and the voltage at pin 3) is delayed so as to allow transient internal chemical activity within the battery to go to completion so as to provide for a more accurate measure of the battery voltage under load. This delay is provided for by resistor R30 and capacitor C15, which are both connected to pin 7 of the Window Comparator U8. Resistor R30 and capacitor C15 delays the aforementioned comparison by several milliseconds so as to allow battery internal equilibrium to be attained. At the end of this delay, Window Comparator U8 compares the voltage at pins 2, 3, and 5 as described above and drives pin 1 of Window Comparator U8 accordingly.

If the voltage change across the loaded battery remains within the 0.235 V threshold or less, pin 1 of Window Comparator U8 will remain high. This will in turn cause the output of inverter U3F, which is a 4049 Hex Inverting Buffer produced by National Semiconductor, to remain low.

If the battery terminal voltage sags by more than 0.235 volts while under the test load, then pin 1 of Window Comparator U8 will go low, forcing the output of inverter U3F to go high which will set the LOW-POWER flip-flop U6B, which, in turn, causes pin 15, Q of this LOW-POWER CD4027 flip--flop U6B, to go high. While this provides base drive current to transistor Q13, normally no current will flow into the base of transistor Q13 nor through the LOW BATTERY LED D28. Therefore, LED D28 will not be illuminated until either one of two specific events occurs.

These two specific events are described as follows:

If the service switch 27, which is activated when the apparatus 1 is being refilled or serviced, is activated, the anode end of diode D30 will be connected to the 12 volt battery. This will cause base drive current to flow via resistor R32 to the base of transistor Q14 thereby causing current to flow in Q14. The current flow through transistor Q14 provides a ground path for the base drive current in transistor Q13, turning it on, and allowing current to flow through the LOW BATTERY LED D28 and resistor R48. LOW BATTERY LED D28 can be situated within the apparatus 1 in a location where it can be seen by the person refilling or servicing the machine. The LOW BATTERY LED D28 could be visible only from the interior of the apparatus or a hole could be placed in the exterior shell of the vending apparatus so as to allow LED D28 to be viewed from the exterior of the apparatus. While it is not a favorable practice, the LOW BATTERY LED D28 may even be placed external to the vending apparatus.

The above same series of events occurs whenever 12 Volt and 24 Volt DC power is switched ON during a transaction, such as when a coin or bill is inserted into the apparatus 1. Upon such an occurrence, the LOW BATTERY LED D28 is illuminated in a manner similar to that described above except that the 12 Volt DC supply voltage is applied via diode D29.

It may also be desired to illuminate the LOW BATTERY LED D28 exclusively upon the activation of the service switch 27. If such is desired, all that need be done is to remove diode D29 from the circuit. In this manner, LOW BATTERY LED D28 will only be illuminated when the vending apparatus is being serviced or refilled.

This technique is yet another means of conserving power in that the illumination of the LOW BATTERY LED D28, or in providing a base drive current to transistor Q13 does not occur except in those instances when the apparatus is being used or is being serviced.

Diode D34 is employed to inhibit the setting of the LOW BATTERY flip-flop U6B when the control system is in normal use since this will provide an additional drain on the batteries 14 and cause a premature indication of a low battery power situation. Therefore the LOW BATTERY flip-flop U6B will not be set prematurely.

When the WAKE-UP flip-flop U2A is active, its output Q, pin 1, is high, and it will turn on the 12 Volt and 24 Volt DC power sources (12 V SWITCHED ON and 24 V SWITCHED ON, respectively). Further, the Q output, pin 2, of WAKE-UP flip-flop U2A will be low during this period and will via diode D34 thus prevent the LOW BATTERY flip-flop U6B from being set. This is accomplished by holding the SET input, pin 9, of the LOW BATTERY flip-flop U6B low. Resistor R51 limits the current that can be supplied by the inverter U3F to levels that WAKE-UP flip-flop U2A can accommodate.

When the output, pin 3, of counter U7 goes high the application of the 1 amp load resistor R39 on the battery 14 is initiated. Further, this action causes, via the resistor/capacitor delay network formed by resistor R29 and capacitor C14, a base drive current via resistor R43 to transistor Q12. That transistor inverts the delayed signal from the output, pin 3, of counter U7. The signal is inverted once again by inverter U3B and applied to the RESET pin, pin 12, of the counter U7. This activity will force the output, pin 3, of counter U7 low again turning off transistors Q10 and Q11 Which will remove the 1 amp test load. This action also removes the base drive current to transistor Q12 turning it off.

Resistor R40 and LED D25 provide a visual indication of the battery testing performed inside the vending apparatus. Capacitor C20 is utilized to bypass the supply pin, pin 8, of Window Comparator U8.

Methods or means other than the present selectively activated LED may be used to display a low battery power condition. These well known alternative methods or means include, but are not limited to, an acoustical (Sonalert) device, a two position rotary magnetic indicator such as is used for the "ACCEPT $1/COINS ONLY" status Display 6 to be described below, an LCD icon or display, a latching relay, a rotary motor driven display, a linear motor driven display, or a spring loaded solenoid release "mouse trap" flag. These alternative methods or means also can be used either individually or in combination with one another as appropriate.

When the batteries 14 have been changed, resistor R45 and capacitor C17, connected to the input of inverter U3A, cause a timing cycle to be initiated so as to reset the LOW BATTERY flip-flop U6B. This is performed by resistor R45 which drains off the voltage which was stored on capacitor C17 when the battery 14 is disconnected. When the fresh battery is connected, capacitor C17 must charge through resistor R45. While the voltage on capacitor C17 is low, the output of inverter U3A is high which resets the LOW BATTERY flip-flop U6B. Also, via the action of transistors Q10 and Q11 on resistor R30 and capacitor C15, WINDOW COMPARATOR U8 of the low battery test circuit 40 is cleared independent of the count in the counter U7. The residual count in the CD4060 counter U7 is reset to zero because resistor R44 now provides base drive current for transistor Q12 which forces the output of inverter U3B high, forcing the RESET pin, pin 12, of counter U7 high.

The output of inverter U3A is also used to preset the state of DISPLAY flip-flop U6A (see FIG. 7C) and that of the external display 6. During a battery replacement, it is possible to have the DISPLAY flip-flop U6A and the external bistable magnetic display 6 in different states because of the transient behavior inherent in battery lines during battery replacement. Inverter U3A is utilized to ensure that the state of the DISPLAY flip-flop U6A and the state of the external display 6 are in agreement when the battery is replaced. The DIS- PLAY flip-flop U6A is preset so that the $\overline{Q}$ output, pin 2, is high. Further, via the action of resistor R56, the reset pulse is applied to transistors Q8 and Q9 which forces the external bistable magnetic display 6 to the "ACCEPTS $1" state. Diode D27 from the collectors of transistors Q8 and Q9 force on the 24 V SWITCHED voltage so that there is power available to permit the display 6 to change state during these periods. The agreement of the states of DISPLAY flip-flop U6A and the bistable magnetic display 6 serves to eliminate any potential operational ambiguity.

"ACCEPT $1" or "COINS ONLY" Display

It is important to be able to present to a potential user information concerning the use of bills. If the coin mechanism 16 is unable to make change for bills deposited because of insufficient coins in the coin storage tubes of the mechanism 16, the control system needs to convey that information to the user. Similarly, if there are sufficient coins to make change, the user needs to be so advised.

One aspect of the present invention provides the means described above. As such, if sufficient coins are not present in the coin storage tubes, then any bill will be rejected by the vending apparatus.

Since both the coin mechanism 16 and the bill validator 17 are unpowered during the power down or nap modes, the apparatus of the present invention provides for an unpowered means to display information to the customer concerning the acceptability of bills and coins. The display means requires absolutely no current to maintain its display state. Further, the present invention stores the necessary information as to whether the system can make change based on information obtained at the end of the last vend or activation cycle. This prevents the apparatus from having to run such a system test after the bill has been inserted during the present wake-up state. Therefore, valuable time and power will not be lost or expended in deciding whether a bill or only coins can be accepted.

The circuitry which provides for the "ACCEPT $1" or "COINS ONLY" display is the "ACCEPT $1"/"COINS ONLY" display circuit 50 so labeled in FIG. 7 and FIG. 7C. The display circuit 50 is built around DISPLAY flip-flop U6A, which is typically a CD4027 JK flip-flop such as that produced by National Semiconductor. The DISPLAY flip-flop U6A drives via inverters and transistors a bistable magnetic display 6 such as that manufactured by Staver. The bistable magnetic display 6 has two stable states and is typically a cylinder which can carry a message and which is driven to either a clockwise or a counterclockwise position by a pulse of current through a coil which either adds to, or opposes, an existent magnetic field. Line P32 (see FIG. 7B) connects from the coin mechanism 16, via connector P3, to the CLOCK input, pin 3, of the DISPLAY flip-flop U6A. This line P32 allows the state of the DISPLAY flip-flop U6A to be changed. A second line P34 from pin 8 of connector P3, which connects from the $\overline{Q}$ bar output, pin 2, of DISPLAY flip-flop U6A allows the coin mechanism 16 to read the state of the DISPLAY flip-flop U6A.

As an example, assume the $\overline{Q}$ output, pin 2, of the DISPLAY flip-flop U6A is high, hence, the Q output, pin 1, of DISPLAY flip-flop U6A is low. This $\overline{Q}$ high, Q low state is the logic state associated with the accept bill ("ACCEPT $1") mode signifying that change exists in the coin mechanism storage tubes so as to allow the insertion by a user of dollar bills. In this mode, the display "ACCEPT $1" will appear on the bistable magnetic display 6. If, just prior to the coin mechanism's 16 shutting off of the Control Board 11 by resetting WAKE-UP flip-flop U2A (see FIG. 7A), it is discovered that the last change making operation depleted the coin storage tubes so that dollar bills could no longer be accepted, the coin mechanism 16 will check the status of the $\overline{Q}$ output, pin 2, of DISPLAY flip-flop U6A and find that it is high. The coin mechanism 16 will then pulse the CLOCK line, pin 3, of DISPLAY flip-flop U6A which will cause flip-flop U6A to change its state and the $\overline{Q}$ output, pin 2, of the DISPLAY flip-flop U6A will then go low. As a result of the low state on pin 2 of the U6A flip-flop, the output on the inverter U5C will go low, since the Q output, pin 1, of the DISPLAY flip-flop U6A will be high. Further, via the action of capacitor C12, the output of inverter U5D will go high momentarily which will force transistors Q6 and Q7 to turn on. This circuit activity will cause the state of the bistable magnetic display 6 to change its state and display a "COINS ONLY" display.

The coin mechanism 16 will then check the state of the $\overline{Q}$ output, pin 2, of DISPLAY flip-flop U6A, find that it is low, and then go into the nap mode. If DISPLAY flip-flop U6A is in the wrong state, the coin mechanism 16 will pulse it again until its state is correct. Diode D12 and resistor R24 prevent damage when coin mechanism 16 is unpowered and also provides a means of protecting the 5 Volt DC voltage limit of the coin mechanism microprocessor from the 12 Volts DC present at, and used to operate, the Control Board 11.

Transistors Q6 and Q7 provide sufficient drive to display connector P6 (see FIG. 7A), pin 1, to change the state of the bistable magnetic display 6 when such switches its display from "ACCEPT $1" to "COINS ONLY". Referring to FIG. 7B, as C12 and resistor R25 are used to operate the transistors Q6 and Q7 only via inverter U5D from the positive edge of the signal supplied to inverter U5C. Diodes D13 and D14 protect the input of inverter U5D from damage. Capacitor C13 and resistor R27 produce a pulse from the output of inverter U5E when its input goes positive. Further, diodes D16 and D17 protect the input of inverter U5F as well. Transistors Q8 and Q9 provide sufficient drive to display connector P6, pin 2 (see FIG. 7A), to change the state of the bistable magnetic display 6 from "COINS ONLY" to "ACCEPT $1". Resistor RS0 serves to limit the current through the coils of the bistable magnetic display device 6.

The bistable magnetic display device 6 requires a signal to cause it to change its display state. After its display has been changed, no power at all is required to drive the display 6. This is another power conservation technique employed by the present invention. Of course, any suitable messages may be displayed on the display 6.

While a magnetic bistable display element 6 with the legends "ACCEPT $1" and "COINS ONLY" is presently used to display the status of the vending apparatus for acceptance of mixtures of coins and/or dollar bills, other means also may be used to present this information to a potential user. These well known means include, but are not limited to, an LDC icon or display, a blinking LED or 7-segment display that is actuated by the presence of a potential user, a latching relay, a rotary motor driven display, or a linear motor driven display. These alternative means can also be used either individually or in combination with one another as appropriate.

Inhibit Circuit

During the periods when the power from the 12 Volt and 24 Volt DC power sources are applied and removed to and from the system circuitry, the lines 12 V SWITCHED ON and 24 V SWITCHED ON turn on and off correspondingly. Referring to FIG. 7B, the 12 V SWITCHED ON and 24 V SWITCHED ON lines turn on and off, the line P32, from connector P3, pin 3, which leads from the coin mechanism 16 to the CLOCK pin, pin 3, of DISPLAY flip-flop U6A, may drop up and down as power is applied and removed. This causes glitches or spikes at the CLOCK pin, pin 3, of DISPLAY flip-flop U6A which may affect the state of DISPLAY flip-flop U6A. To prevent such glitches or spikes from affecting the state of DISPLAY flip-flop U6A, an inhibit circuit 60, shown in FIG. 7 and FIG. 7A, is connected to the CLOCK pin, pin 3, of DISPLAY flip-flop U6A.

The inhibit circuit 60 works in the following manner. When there is no power applied to the control system circuitry and, therefore, no power applied to the coin mechanism 16 and to the bill validator 17, the Q output, pin 1, of WAKE-UP flip-flop U2A is low. The low state of the output, pin 1, of WAKE-UP flip-flop U2A, coupled with the action of diode D10 and resistor R22, maintains the input of the inverter U5A low. The output of inverter U5A drives the input of inverter U5B. Hence, the output of U5B is low when the output pin 1, of the WAKE-UP flip-flop U2A is low. Diode D11 holds the CLOCK pin 3, of DISPLAY flip-flop U6A low, thereby preventing any glitches or spikes from changing the state of the DISPLAY flip-flop U6A when the coin mechanism 16 or the bill validator 17 are unpowered. When power is applied to the coin mechanism 16 and to the bill validator 17, the Q output, pin 1, of WAKE-UP flip-flop U2A will go high and, therefore, turn on transistors Q3, Q4, and Q5 (see FIG. 7C). When this occurs, capacitor C11 is discharged and continues to hold the CLOCK pin, pin 3, of the DISPLAY flip-flop U6A, low until the line P32 from the coin mechanism 16 has stabilized. Once the charge on capacitor C11 has increased sufficiently, the output of inverter U5B will swing high allowing the CLOCK pin, pin 3, of DISPLAY flip-flop U6A to be controlled by the signals received from the coin mechanism 16.

When power is removed from the coin mechanism 16, and from the bill validator 17, the Q output, pin 1, of WAKE-UP flip-flop U2A, will go low, thereby turning off transistors Q3, Q4, and Q5. To prevent changes on the coin mechanism line from inadvertently changing the state of DISPLAY flip-flop U6A, diode D10 starts conducting and dumps the charge which was previously stored on capacitor C11. The discharging of capacitor C11 presents a low input to inverter U5A and a resulting low output from inverter U5B. The low output from inverter U5B, coupled with the presence of diode D11, serves to clamp the CLOCK pin, pin 3, of DISPLAY flip-flop U6A. As a result of the foregoing, DISPLAY flip-flop U6A will ignore any spurious signals which might occur during this period. Resistor R23 is employed in the inhibiting circuit 60 so as to prevent any high current from the coin mechanism output line P32 from affecting the operation of the inverter U5B or DISPLAY flip-flop U6A.

Vend Relay Circuit

When the apparatus 1 is ready to vend or dispense the newspaper or other printed matter, a vend relay in the coin mechanism 16 is activated. Upon such an occurrence, the coin mechanism 16 activates the vend relay circuit 70 on the Control Board 11 with a vend signal which is sent via pin 11, labeled VEND NO, from connector Pe (see FIGS. 7B and 7D).

Referring to FIG. 7D, the operation of the vend relay circuit 70 will now be described. When the vending operation is activated by the coin mechanism 16, power is applied to vend relay RY1 of the vend relay circuit 70. Vend relay RY1, a 24 Volt relay such as Model AZS-1C-24DE manufactured by American Zettler, applies power to the vending door solenoid 18 (shown in FIG. 6) which is a 24 V solenoid such as Model 11HD-1-24D manufactured by Guardian Electric Mfg. Co., thereby allowing the door 2 of the vending apparatus (shown in FIG. 1) to be opened and the newspaper or other printed matter removed from the apparatus 1. The vending door solenoid 18 must be substantially robust. As such, the activation of the vending door solenoid 18 normally requires substantial amounts of power. Once the vending door solenoid 18 has been activated, substantially less power is required to hold it in its energized state. So as to reduce the power required to continue to drive the vending door solenoid 18, a power conservation circuit is employed in the present invention.

Capacitor C21 is connected to the 24 V SWITCHED line via resistor R49. Capacitor C21 is charged via resistor R49 prior to activation of relay RY1. When the relay RY1 turns on, the capacitor C21 discharges into the vending door solenoid 18 which activates. As noted before, less power is required to hold the vending door solenoid 18 on. The power delivered to the vending door solenoid 18 after it has been activated is limited by resistor R49 which reduces, by a factor of 4 the power required to hold the vending door solenoid 18 on. When the vend signal is removed by the coin mechanism 16, the relay RY1 opens and power is removed from the vending door solenoid 18. Capacitor C21 is then allowed to charge back up to its maximum voltage in waiting for the next vend signal to be applied by the coin mechanism 16, at which time it will, via its discharge, again supply current sufficient to activate the Vending Door Solenoid 18.

While a power reduction means has been described which reduces the power supplied to the vending door solenoid 18 after its initial activation, power may also be reduced by supplying intermittent power to the solenoid 18 subsequent to its initial activation.

It is also possible to reduce the power expended by the present invention by employing another sensing switch in addition to the blocker switch which is presently employed.

The blocker switch is employed to detect when the vending door 2 is open. The blocker function as it relates to vending apparatus operation will be described in more detail below in relation to the description of FIG. 10.

The additional sensing switch may be employed, for example, to sense vending door 2 movement from its home, or closed, position and said switch may then be employed to activate the vending door solenoid 18.

Other well known methods or means by which power may be reduced in the present invention includes, but are not limited to, employment of a mechanical flip-flop with alternating mechanical release and latching coils (dual coil solenoid), a mechanical latch to hold the vending door 2 in an unlatched state, a selective powerdown mode during the wake-up mode of system operation which reduces power with wake-up triggers to drive the system into its next powered state as well as the utilization of power switches to remove power from system components and devices when their functionality has been completed such as when the bill validator 17 has accepted a bill and has communicated such credit to the Coin Mechanism 16 (power shedding).

Also depicted in FIGS. 7A–7C are the connectors for the interfacing of the various peripheral devices and signals with the control system on the Control Board 11. These connectors are: P1 (service switch), P2 (battery connection), P3 (coin mechanism connection), P4 (start sensors), P5 (rack door and blocker), and P6 (coins/bills/coins only indication). These connectors may be of the Mass Termination type such as Model MTA-156 connectors manufactured by AMP. Fuses, fuse holders, battery terminal sockets, and quick release connectors (not shown) are utilized in the present invention.

FIG. 7B also depicts coin mechanism translation circuit 75, which is circuitry inherent in the coin mechanism 16, and which serves to translate the 0 to 5 Volt DC logic levels utilized by components of the coin mechanism 16 to a 0 to 12 Volt DC logic levels for utilization by the components of the Control Board 11.

A listing of the components utilized on the Control Board 11, as shown in FIGS. 7A–7D, along with associated connectors of interfacing units, is provided below. Description, model number, and manufacturer information is also provided where applicable.

| Component | Description/Model No./Manufacturer |
|---|---|
| | CONNECTORS AND CONTROL BOARD 11 COMPONENTS |
| P1 | Service Switch Connector; MTA-156 2-position Mass Termination Connector; AMP |
| P2 | Battery Connector; MTA-156 8-position Mass Termination Connector; AMP |
| P3 | Mech Connector; MTA-156 13-position Mass Termination Connector; AMP |
| P4 | Start Sensors Connector; MTA-156 6-position Mass Termination Connector; AMP |
| P5 | Rack Door and Blocker Connector; MTA-156 7-position Mass Termination Connector; AMP |
| P6 | Coins Only Indicator Connector; MTA-156 5-position Mass Termination Connector; AMP |
| D1, D2, D3, D4, D5, D6, D7, D8, D9, D10, D11, D12, D13, D14, D15, D16, D17, D18, D21, D33, D31 D22, D23, D36, D30, D29, D34, D27, D35 | 1N4148 |
| D32 | 1N4004 |
| D25, D26 | LED; 164UR; AND |
| D28 | LED; AND180CRP; AND |
| U1 | BANG-BANG Controller; LTC 1041; Linear Technology |
| U2A/U2B | DUAL J-K MASTER/SLAVE Flip-flop; CD4027; National Semiconductor |
| U3A/U3B/U3C/ U3D/U3E/U3F | HEX INVERTING BUFFER; CD4049; National Semiconductor |
| U4 | 14-STAGE RIPPLE BINARY COUNTER; CD4060; National Semiconductor |
| U5A/U5B/U5C/ U5D/U5E/U5F | HEX INVERTING BUFFER; CD4049; National Semiconductor |
| U6A/U6B | DUAL J-K MASTER/SLAVE Flip-flop; CD4027; National Semiconductor |
| U7 | 14-STAGE RIPPLE CARRY BINARY COUNTER; CD4060; National Semiconductor |
| U8 | WINDOW COMPARATOR; LTC1042; Linear Technology |
| Q1 | Transistor; 2N3904 |
| Q2 | FET; 1 FRF9010 |
| Q3 | Transistor; 2N3904 |
| Q4, Q5 | FET; 1FRF9010 |
| Q6 | Transistor; 2N3904 |
| Q7 | Transistor; 2N6718 |
| Q8 | Transistor; 2N3904 |
| Q9 | Transistor; 2N6718 |
| Q10 | Transistor; 2N3904 |
| Q11 | FET; 1FRF9010 |
| Q12, Q13, Q14 | Transistor; 2N3904 |
| R1 | Resistor 120KΩ |
| R2, R3 | Resistor 220KΩ |
| R4 | Resistor 47KΩ |
| R5 | Resistor 100KΩ |
| R6 | Resistor 2.2MΩ |
| R7 | Resistor 10KΩ |
| R8, R9 | Resistor 220KΩ |
| R10 | Resistor 33KΩ |
| R11 | Resistor 2.2KΩ |
| R12 | Resistor 200KΩ |
| R13 | Resistor 47KΩ |
| R14, R15, R15, R17 | Resistor 100KΩ |
| R18 | Resistor 1MΩ |
| R19 | Resistor 470KΩ |
| R20 | Resistor 75KΩ |
| R21 | Resistor 100KΩ |
| R22 | Resistor 470KΩ |
| R23, R24 | Resistor 10KΩ |
| R25 | Resistor 680KΩ |
| R26 | Resistor 10KΩ |
| R27 | Resistor 680KΩ |
| R28, R29 | Resistor 10KΩ |
| R30 | Resistor 100KΩ |
| R31 | Resistor 2.2MΩ |
| R32 | Resistor 22KΩ |
| R33 | Resistor 47KΩ |
| R34, R35 | Resistor 2.2MΩ |
| R36 | Resistor 47KΩ |
| R37 | Resistor 220KΩ |
| R38 | Resistor 100KΩ |
| R39 | Test Load Resistor 12Ω, 3 Watts |
| R40, R41 | Resistor 1KΩ |
| R42 | Resistor 220KΩ |
| R43 | Resistor 220KΩ |
| R44, R45, R46 | Resistor 100KΩ |
| R47 | Resistor 22KΩ |
| R48 | Resistor 4.7KΩ |
| R49 | Resistor 18KΩ |
| R51 | Resistor 47KΩ |
| R52 | Resistor 100KΩ |
| R53 | Resistor 220KΩ |
| R54 | Resistor 470KΩ |
| R55 | Resistor 2.0MΩ |
| C1 | Capacitor 6800pF |
| C2 | Capacitor 0.01μF |
| C3 | Capacitor 10μF |
| C4 | Capacitor 0.01μF |
| C5 | Capacitor 10μF |
| C6 | Capacitor 0.01μF |
| C7 | Capacitor 10μF |
| C8 | Capacitor 1.0μF |
| C9, C10 | Capacitor 0.01μF |
| C11, C12, C13 | Capacitor 0.1μF |
| C14 | Capacitor 4.7μF |
| C15 | Capacitor 0.01μF |
| C16, C17 | Capacitor 1μF |
| C18 | Capacitor 0.01μF |
| C19 | Capacitor 10.0μF |

-continued

| | Description/Model No./Manufacturer |
|---|---|
| C20 | Capacitor 10μF |
| C21 | Capacitor 2200μF |
| C22, C23, C24, C25, C26, C27, C28 | Capacitor 0.1μF |
| C29 | Capacitor 0.01μF |
| RY1 | Relay 24V; AZ8-16-24DE; American Zettler |
| C30 | Capacitor 0.04μF |
| VOLTAGE TRANSLATION CIRCUIT 75 COMPONENTS | |
| Quantity | |
| 1 | CAPACITOR 0.1μF |
| 5 | Resistors 10KΩ |
| 4 | LOW POWERED, LOW OFFSET VOLTAGE QUAD COMPARATOR; LM339; National Semiconductor |

A description of the overall operation of the present invention, in its preferred embodiment as a battery powered vending apparatus for newspapers or other printed materials, will now be set forth with reference to FIGS. 8, 9, and 10.

Figure 8:
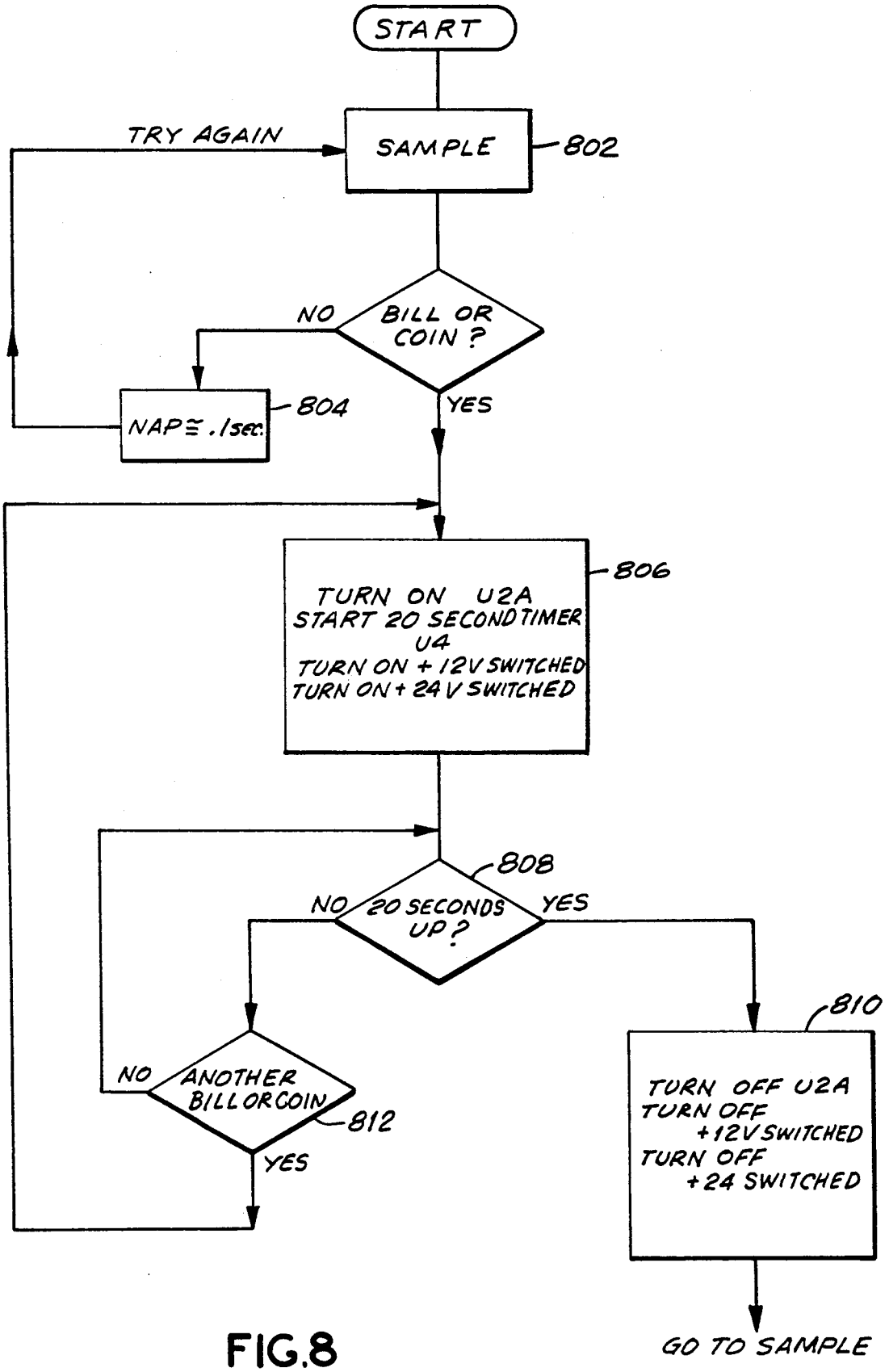
FIGS. 8, 9, 10A, 10B, and 10C are flow charts illustrative of the operation of the present invention in its preferred embodiment.

Referring to FIG. 8, initially the control system of the apparatus 1 is in the nap mode or in its idle state when no one is attempting to purchase a newspaper. In the nap mode, the background timer circuit 30 provides sensor sampling signals to the coin sensor 19 and to the bill sensor 21 in the coin chute 15 and bill snout 20, respectively. Sensor sampling 802 occurs at a rate of 12 samples per second, or at about every 80 milliseconds. If no coin or bill is detected by the sensors during this sampling period, the control system "naps" 804 for about another 80 milliseconds, after which another sampling signal is applied to the coin sensor 19 and bill sensor 21 802. Sensor sampling pulses last under 5 milliseconds.

If, however, a coin or bill is detected by either of the respective sensors, the WAKE-UP flip-flop U2A is set 806. This action starts the 20 second system operational timer U4 and applies the 12 Volt and 24 Volt DC power to the Control Board 11 circuitry, as well as to other devices in the vending apparatus (i.e., coin mechanism 16 and bill validator 17). The 20 second timer U4 functions so as to provide power to the vending apparatus system until the vending operation is complete. Timer U4 serves to provide for a system power up for a time sufficient to allow the vending apparatus to complete its operation (i.e. return change to the user), prior to the apparatus returning to the nap mode.

When the 20 second timer U4 times out 808, WAKE-UP flip-flop U2A is reset 810 and the 12 Volt and 24 Volt DC power sources are turned off. The control system then goes back into the nap mode 804 and begins sampling 802 the coin and bill sensors 19 and 21, respectively, once again.

It should be noted that upon the completion of a vend operation, the 20 second timer U4, is cleared even if a portion of the 20 seconds still remains on it. This will serve to shut down system power after the vending operation has been fully completed. This feature further serves to conserve power.

If the 20 second timer U4 has not timed out, the system continues to be powered up. During this system operation, the control system is still sampling the coin sensor 19 and the bill sensor 21. If another coin or bill is inserted and detected by their respective sensor, the control system again restarts the 20 second timer U4. This ensures that the vending apparatus, as well as the user, has 20 seconds to complete the vending process after receipt of, or insertion of, the last valid coin or bill. If no additional coin or bill is inserted, the system timer U4 continues its 20 second timing period. As described above the flowchart of FIG. 8 illustrates the operation of the Control Board 11.

Figure 9:
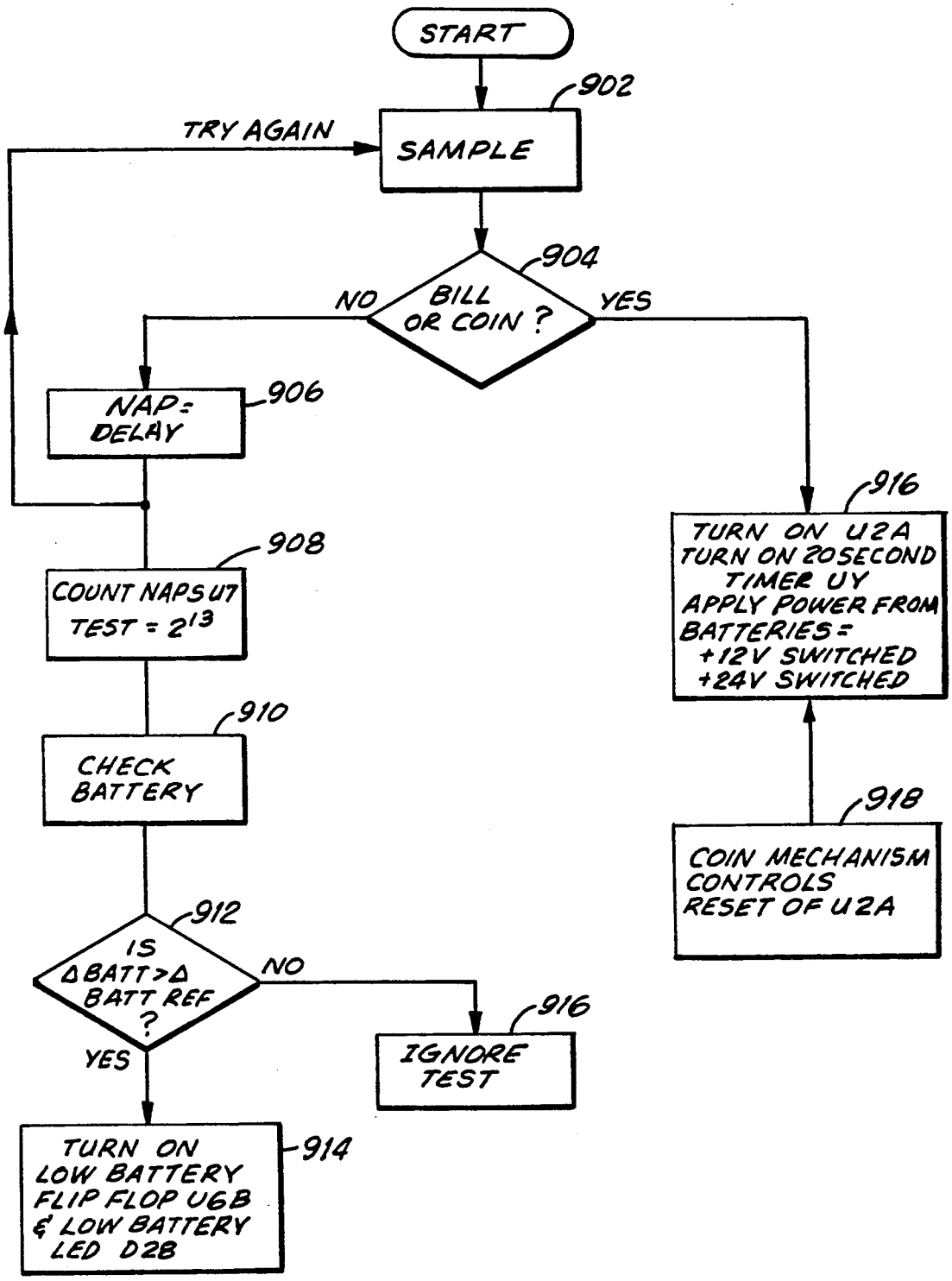

The flowchart shown in FIG. 9 is an extension of the system operation as illustrated by FIG. 8 showing additional system features. Essentially, FIG. 9 is illustrative of the following:

After each nap period 906 has occurred, counter U7 is incremented 908. Once a count of 8,192 ($=2^{13}$) has been reached, the battery energy test circuit 40 is activated 910 and the battery is tested. If the change in the battery terminal voltage (the difference between the battery terminal voltage in the unloaded and loaded states) is greater than or equal to a predetermined delta voltage limit 912, the battery is considered to be low on energy, the LOW BATTERY flip-flop U6B is set, and the LOW BATTERY LED D28 may be illuminated 914 if other specified conditions are met. Note that LOW BATTERY LED D28 will only be illuminated when either the service switch 27 is activated (when the vending apparatus is being refilled), or when the 12 Volt DC power source is applied to the control system such as when a user deposits coins or bills into the vending apparatus. This action conserves power as it will result in LOW BATTERY LED D28 being illuminated only during those times when someone will be present to see it. If, however, the change in the battery terminal voltage is less than the predetermined voltage change limit, the battery has sufficient power and the control system ignores the measurement 916.

FIG. 9 also illustrates that once a coin or bill has been inserted into the vending apparatus 904, WAKE-UP flip-flop U2A is set, the 20 second system operational timer U4 is started, and 12 Volt and 24 Volt DC power sources are applied to the system 916. The count in the 20 second timer U4 may be cleared to extend the power up time by the action of the microprocessor in the coin mechanism. The WAKE-UP flip-flop U2A may be reset by the coin mechanism 918 so as to turn off system operation (i.e., clear the 20 second timer U4 and remove the 12 Volt and 24 Volt DC power sources from the system). The coin mechanism would provide such a reset signal to WAKE-UP flip-flop U2A upon the occurrence of certain events such as when the coin mechanism 16 has completed the vending operation (i.e., sent the vend signal to the vending door solenoid 18 and paid out any change due to the user).

Figure 10A:
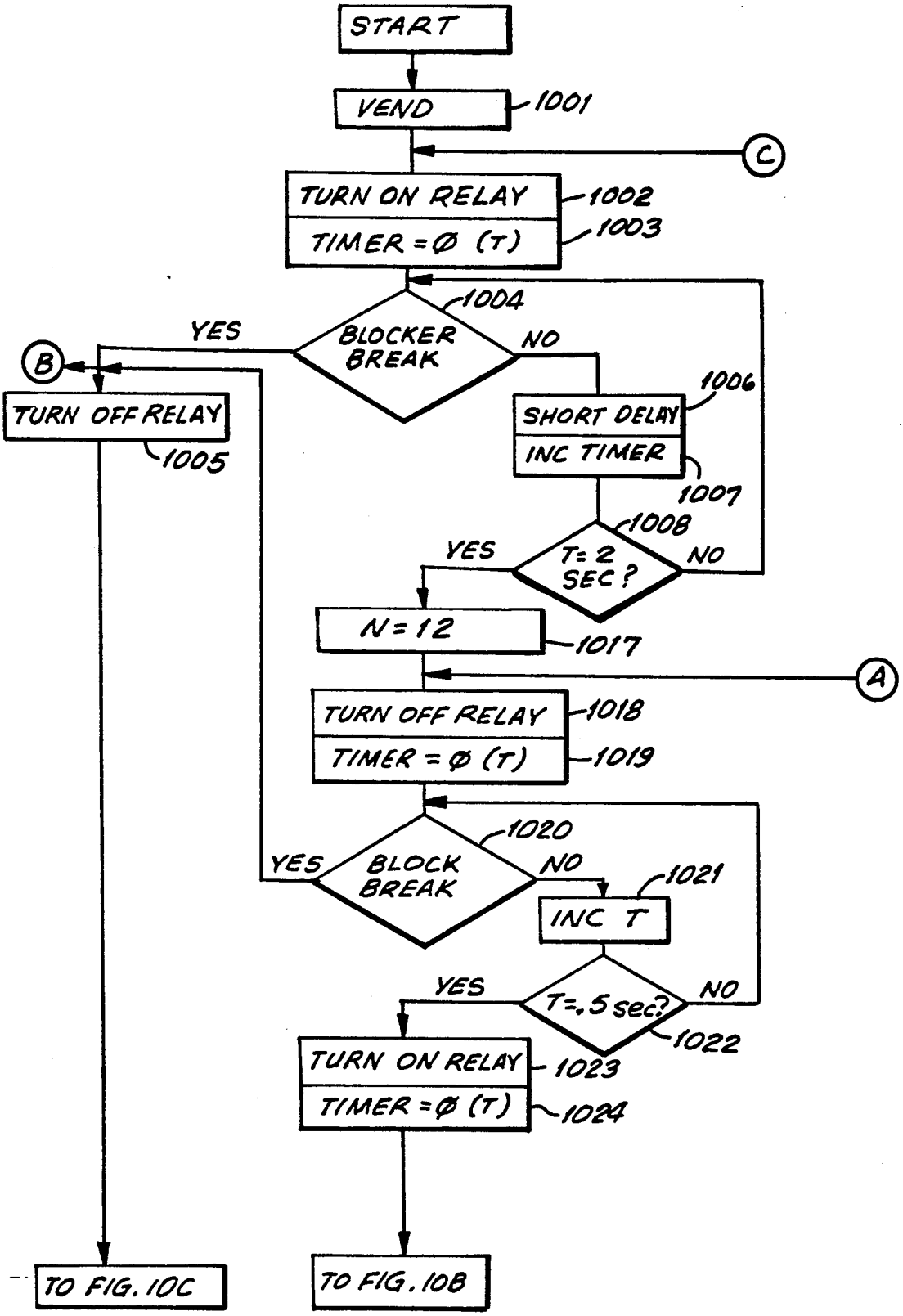
Figure 10B:
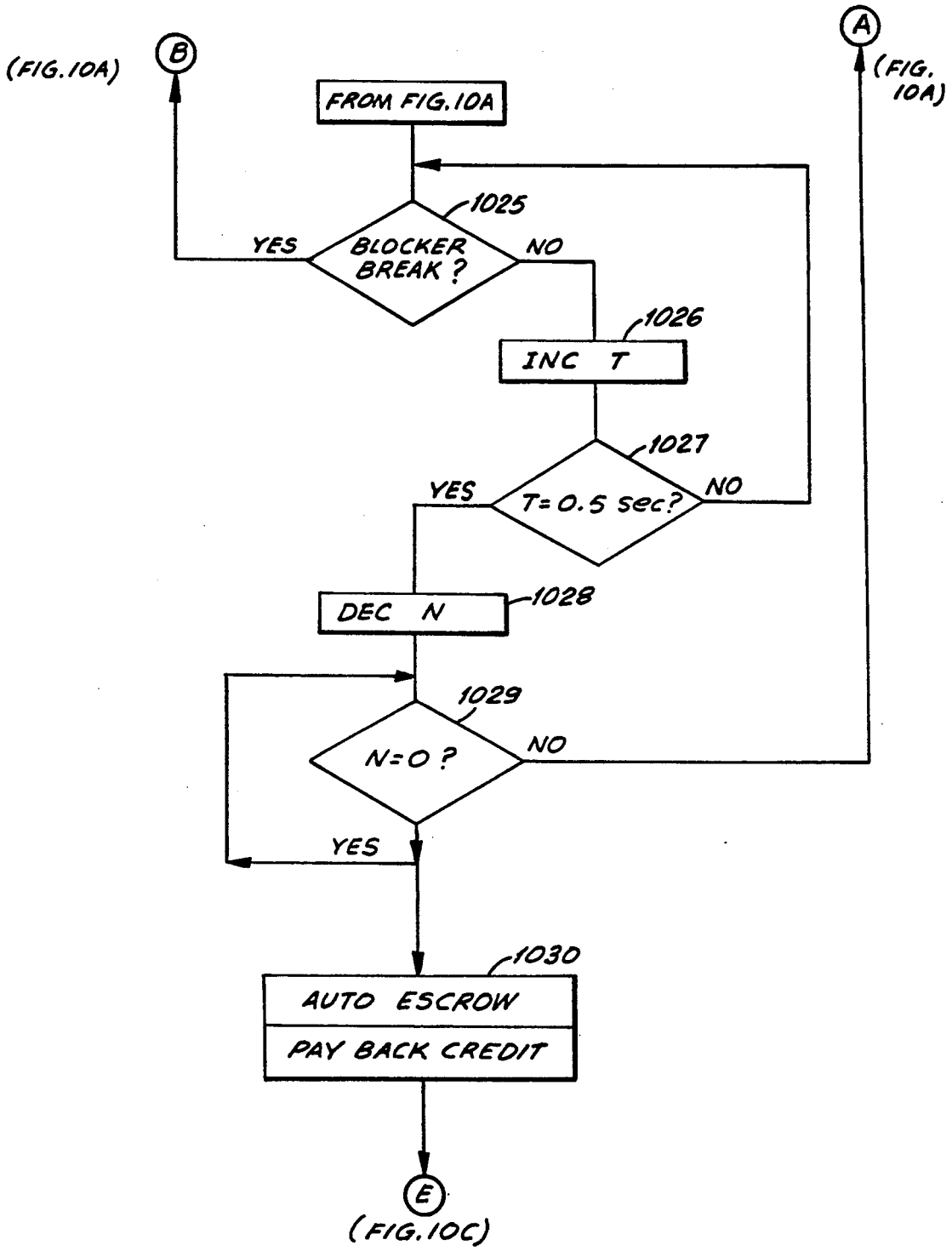
Figure 10C:
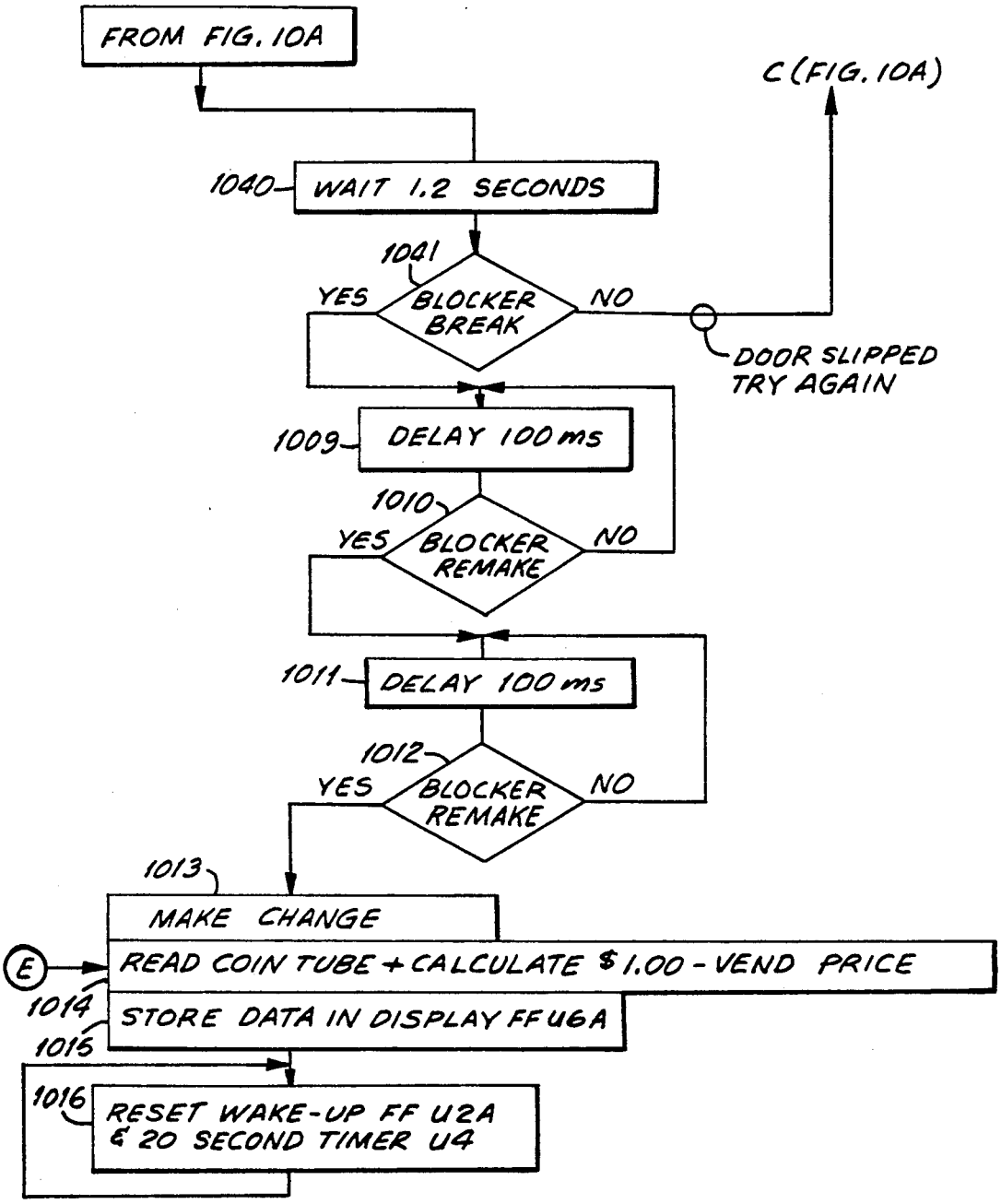

FIGS. 10A–10C are illustrative of the actual vending operation of the preferred embodiment of the present invention. Once the presence of a coin or bill is detected by their respective sensors 19 and 21, the WAKE-UP flip-flop U2A is set and 12 Volt and 24 Volt DC power is supplied to the various system components. The coin mechanism 16 and bill validator 17 combination then determines if the sufficient amount of money has been deposited into the vending apparatus. If insufficient funds exist, the vending apparatus waits until additional money is deposited. As noted before, the vend price of the product or service is established by setting the price switches in the coin mechanism 16.

Once the correct amount of money, an amount at least equal to the vend price of the newspaper, has been deposited, the coin mechanism 16 issues a vend signal 1001 (see FIG. 10A) to the relay RY1 which is located on the Control Board 11. The vend signal turns relay RY1 on 1002. A vend system timer is then set to zero 1003 and a test is made to determine if blocker break exists 1004 (i.e., whether the vending door 2 is open). There is then a 1.2 second pause 1040 (see FIG. 10C) and if blocker break is no longer detected 1041, the system begins again at 1001 with the vend relay at 1002 and the timer set to zero 1003. This procedure is employed to prevent a situation where the vending door 2 slips out of the user's hand. If there exists a blocker break, the vend relay RY1 is turned off 1005, to conserve power. If blocker break has not yet been detected, there occurs a similar blocker break test after 2 seconds have elapsed 1006, 1007, 1008, and 1004. Then the vend relay RY1 is turned off for 0.5 seconds and then on for 0.5 seconds while looking for blocker break 1017 to 1029. If there is no blocker break detected, the vend relay RY1 is turned on once again 1002 and the above process is repeated.

If a blocker break does occur (see FIG. 10C), a check is made after a 100 millisecond delay period 1009 so as to determine if the vending door 2 has closed 1010. This operation is known as blocker remake (the door has closed).

If there is still no blocker remake, there is another 100 milliseconds delay 1009 before the blocker remake is tested again 1010.

Once the blocker remake has occurred, there is another 100 millisecond delay period 1011 after which the blocker remake test is repeated 1012. The series of 100 millisecond delays are employed to accommodate for any bouncing in the door switch 26 circuit.

Once the blocker remake occurs, the vending apparatus will issue change, if appropriate 1013, check the coin storage tubes of the coin mechanism 16 to determine the amount of coins left therein (to determine if bills may be accepted) 1014, and store the data pertaining to the vending apparatus ability to accept bills or coins only in the DISPLAY flip-flop U6A 1015. The 20 second timer U4 will be restarted so as to allow power to be supplied to the control system and peripheral devices so as to allow for the proper completion of the vending operation (i.e., power to pay out change) 1016. When all of the above has been completed, WAKE-UP flip-flop U2A and the 20 second timer U4 will be reset and the control system will transition back to the nap mode 1016.

If blocker break does not occur within 2 seconds of the activation of relay RY1, the relay is turned off 1018. Thereafter, the relay RY1 is turned off for 0.5 seconds 1019, 1020, 1021, 1022 and on for 0.5 seconds 1023, 1024, 1025, 1026 and 1027. This power off/power on activity continues for 12 seconds 1017, 1028, 1029 and 1018. Note that during each off period and each on period, blocker break is tested 1025 and 1020. If blocker break is determined to exist after a turn off or a turn on of the relay RY1, the system repeats the process outlined above for a blocker break condition.

If no blocker break condition exists after the 12 second (power off, power on) time period, the vending apparatus 1 will automatically return the money it has stored in its escrow to the user 1030.

After an escrow return has occurred, whether it is initiated by a timeout or after a user request before the vend price has been reached, the control system will check the coin storage tubes of the coin mechanism 16 to determine if bills or only coins can be accepted 1014, store such information and reset the WAKE-UP flip-flop U2A and 20 second timer U4 1016. This action puts the control system back into the nap state.

As noted earlier, the Coin Mechanism 16 (Model TRC-6700H) and the Bill Validator 17 (Model VFM1 LO V2CS) are off-the-shelf 117 VAC units produced by Mars Electronics. Since the vending apparatus of the present invention is battery powered, having operating voltages of 12 V DC and 24 V DC, hardware and software modifications were required to be made to the coin mechanism 16 and bill validator 17 so that they would be operable from the DC power source.

Figure 11:
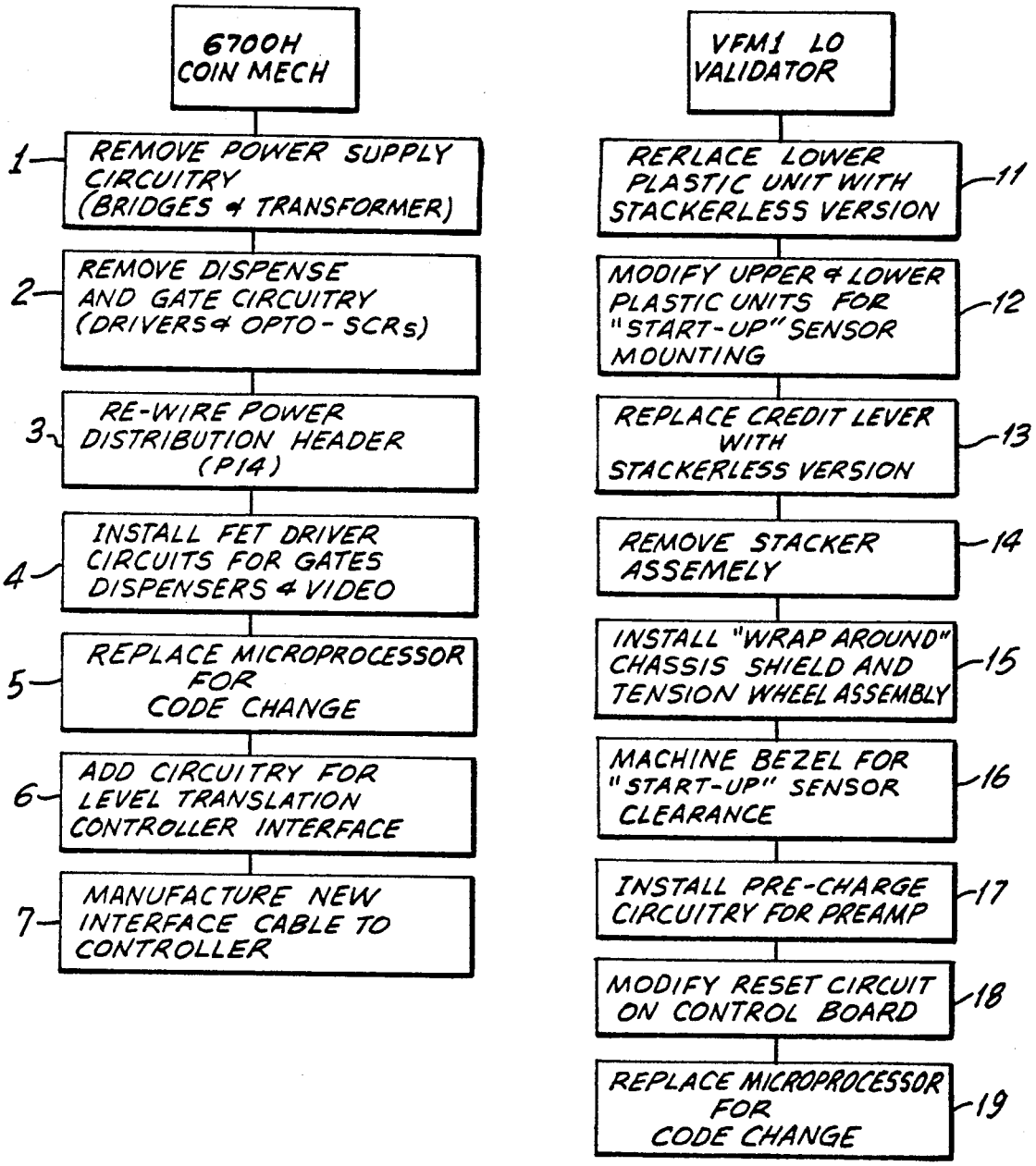
FIG. 11 is a flowchart descriptive of the hardware changes made to the off-the-shelf coin mechanism and bill validator which were required to be performed so as to accommodate the conversion of these devices from AC operation to DC operation.

The coin mechanism 16 and bill validator 17 combination are collectively referred to as the TRC COMBO and the modifications to the hardware and software of both of these devices, so as to allow 24 V DC stackerless operation, are set forth in flowchart form in FIG. 11. It should be noted that some of the referenced changes would not be necessary if the COMBO were available in a stackerless version or in a 24 V DC version.

The modifications to the TRC-6700H coin mechanism and to the VFM1 LO U2CS bill validator are described below with reference to FIG. 11.

TRC-6700H Coin Mechanism

Block 1. Since no DC operated coin mechanism exists at the present time, the power transformer and bridge rectifier circuitry of the coin mechanism power supply circuit were removed. This was performed because there was no longer a need for an AC to DC power conversion. Further, in order to facilitate the operation of the microprocessor and related circuitry of the coin mechanism 16, which requires voltage levels of between 0 to 5 Volts DC and 0 to 15 Volts DC, the 5 Volt DC regulator inherent in the coin mechanism 16 was connected to the 12 V SWITCHED battery line and the 15 Volt DC regulator, also inherent in the coin mechanism 16, was connected to the 24 V SWITCHED battery line. The application of the 12 V DC and 24 V DC power from the vending apparatus power supply to the above noted regulators provides for the supplying of sufficient power to operate the coin mechanism 16.

The above noted changes were made on the coin mechanism control board since the power supply circuitry was incorporated into the coin mechanism itself.

Block 2. The driver circuits for all six drivers, including the drivers for the dispensers, the gates, and the vend relay RY1, were removed. Note that there are three coin dispenser drives (one each for the quarter, dime, and nickel tubes), two solenoid drives (one for each of the two gates) and one vend relay driver. The drivers are usually driven by SCRs which operate on 60 Hz AC. Since the COMBO has only DC supply voltages, the six SCR driver circuits were replaced by six FET (Field Effect Transistors which are DC based) drivers so as to be operable from the 24 V DC supply. These changes, again, were made to the coin mechanism control board. Further, driver chip buffer U3 was changed from a UDN2595 to a UDN2580 for signal level inversion. This change was also made on the coin mechanism control board. Also, since no 24 V DC powered COMBO exists at the present time, the five 117 V AC solenoids and gates in the coin mechanism 16 were removed and replaced by five 24 V DC units.

Block 3. The P14 connector end which services the coin mechanism control board had to be rewired so as to divert supply voltages around the missing transformer and rectifier (removed earlier and discussed in the Block 1 description) and directly to the input side of the 5 V DC and 15 V DC regulators in the coin mechanism.

Block 4. DC based FET drivers were installed as drivers for the Dispensers, the gates, and the vend relay RY1. This was described above in reference to Block 2 wherein it was necessary to replace the SCR AC drivers with FET DC drivers.

Block 5. The conversion from AC to DC power required that numerous changes be made to the software which controls the microprocessor on the coin mechanism control board. Since this requires a microprocessor with different software memory features, the microprocessor had to be replaced. To facilitate this replacement, a new socket, capable of receiving the new microprocessor was inserted into the coin mechanism control board. The masked microprocessor, a Mitsubishi Model 50743, which incorporated the new software changes was replaced by a Mitsubishi EPROM Microprocessor Model 50747 which allows for on-line programmability. Note that later production will not require the above modification as the modified coin mechanism will include the modified microprocessor.

Block 6. Voltage level translation circuitry comprising Comparator Model LM339 produced by National Semiconductor was inserted, on the small board located atop the control board of the coin mechanism 16. Since the coin mechanism circuitry operates on 0 to 5 V DC levels, while the Control Board 11 of the vending apparatus operates on 0 to 12 V DC levels, voltage translation circuitry was required to facilitate this voltage level translation. The voltage translation circuitry referenced above translates the 0 to 5 V DC signals from the microprocessor in the coin mechanism to 0 to 12 V DC signals which are utilized on the Control Board 11 of the vending apparatus.

Block 7. A new interface cable for connecting the coin mechanism 16 to the Control Board 11 of the vending apparatus had to be manufactured. Power and other apparatus operating signals are provided over this cable. The signals provided over this cable include 12 V SWITCHED, 24 V SWITCHED, P30, P31, P32, P34, BLOCKER, and VEND NO.

VFM1 LO V2CS Bill Validator

Block 11. The stacker assembly of the bill validator 17 had to be removed since there was a lack of space available for such in the vending apparatus. It should be noted that the red plastic elements that form the bill passageway in the bill snout 20 extends the entire internal width of the bill validator continuing to the point where the stacker (now removed) would normally be located. Since the stacker had been removed, the lower plastic element had to be replaced with a plastic element which would operate with the modified stackerless version of the bill validator. After the stacker assembly had been removed, the opening in the rear of the bill validator's top sheet metal cover was covered with an associated plastic. Further, two deflection wheels were placed in this vicinity so as to keep the bills directed away from the rear of the bill validator as they pass therethrough. The bills then drop to the bottom of the bill validator compartment.

Block 12. Since the circuitry powering up the bill validator 17 is activated by the sensing of dollar bills as they pass through the bill snout 20, start-up or wake-up sensor 21 had to be inserted into the bill snout 20. This required modifications to the upper and lower red plastic elements that presently house the sensor elements so as to allow the placement of both the LED 92 and phototransistor 93 of the sensor 21 (optoisolator 32) to be housed therein. The sensor elements then had to be mounted and their wires routed away from the plastic elements. The addition of this start-up or wake-up sensor 21 allows for the activation of the vending apparatus when a bill is inserted therein.

Block 13. Since the bill validator 17 was converted to a stackerless version, the credit lever of the bill validator also had to be replaced with a credit lever that would facilitate stackerless operation. The credit lever is a device which is deflected by a bill as it passes by the lever. This deflection is indicative that a bill has been received for validation.

Block 14. The stacker assembly of Bill Validator 17, as described earlier in Block 11 above, had to be removed due to a lack of space available for such in the vending apparatus.

Block 15. The removal of the stacker from the bill validator 17 necessitated the installation of a wrap around chassis shield to protect the area exposed by stacker removal. Further, a tension wheel assembly was required to be installed so as to facilitate the pinching of the bill away from the bill validator as it passes therethrough.

Block 16. Since the application of the bill validator 17 in the vending apparatus necessitated the installation of the start-up or wake-up sensor 21 inside the bill snout 20, the bezel outer covering of the bill snout 20 had to be machined so as to allow for sufficient clearance room for the reception of the sensor elements and their associated wires.

Block 17. Since the bill validator 17 is not powered up at all times and since the validation process requires that the bill validator circuitry be powered up almost instantaneously, a precharge circuit had been installed on the bill validator control board. Further, lines had been run from this circuit to two diodes mounted on the magnetic amplifier circuitry located on the preamp board of the validator. Since power is not constantly applied to the bill validator circuitry, these modifications serve to speed up the operation of the bill validator upon its activation so as to avoid any delay normally associated therewith.

Block 18. Modifications had to be made to the bill validator microprocessor reset circuitry. The microprocessor in the bill validator is reset each time the validator is activated. To facilitate the need to repeatedly reset the microprocessor each time the validator is powered up, the existing deadman timer and power-up circuitry associated with the reset pin of the microprocessor was replaced by a new and faster reset circuitry. This new circuitry was placed on the bill validator control board.

Block 19. Software modifications were required to be made to the bill validator microprocessor due to the conversion from AC operation to pulsed battery operation. To facilitate these modifications, the existing microprocessor had to be replaced. A socket for receiving the new microprocessor was installed on the bill validator control board. The masked microprocessor, which reflected the software code changes, was replaced by an Intel 8749 EPROM microprocessor. The EPROM version microprocessor was employed so as to allow on-line programmability. Note that later production will not require the above modification as the modified bill validator will include the modified microprocessor.

While the present invention in its preferred embodiment has been described in conjunction with the use of coins and dollar bills, it is envisioned that modifications may easily be made to the present invention so as to allow for operation by credit cards, value cards, banknotes, tokens, coupons or other cash alternatives. In such instances, modifications must be made to the sensing and validating mechanisms and also, as needed, to the control system and Control Board 11.

The present invention, while described in the preferred embodiment as being utilized in conjunction with the sale of newspapers or periodicals may also be utilized in the sale of other articles or products. These may include cigarettes, candy, snacks, etc. Further, the present invention may be utilized in turnstiles. In short, the present invention may be employed in any operation where the apparatus is battery powered and experiences long and frequent periods of idle or dead times, during which it must remain alert for any system activation and must promptly transition from the idle or nap state to a fully powered operational state and perform its function.

The present invention may also provide for a battery recharging capability so as to provide for longer battery life and less frequent battery replacement. Electrical recharging means 29 (See FIGS. 5 and 6) may be of the solar recharging type. Recharging means may also include the use of generators located on moving parts in the vending apparatus. Also anticipated is the employment of displacement mats, which are located in front of the vending apparatus and which may utilize piezoelectric means to generate electrical energy from the mere stepping by the user onto the displacement mat. Other recharging means that are known to those skilled in the pertinent art may also be employed in the present invention.

As a result, the description of the preferred embodiment of the present invention is meant to be merely illustrative of the present invention and is not to be construed as limitations thereof. Therefore, the present invention covers all modifications, changes and alternatives in its design, construction and method of use falling within the scope of the principles taught by the present invention.

We claim:

1. A solely battery-powered, money-operated dispensing apparatus, comprising:

a battery;

a bill sensor for sensing the insertion of paper currency;

a bill validator for testing paper currency;

a delivery means; and a control means connected to the battery, bill sensor, bill validator, and delivery means, wherein the control means normally operates in a low-power nap mode to conserve power, strobes the bill sensor during the nap mode and powers-up the apparatus and actuates the bill validator when paper currency insertion is sensed, activates the delivery means if an adequate amount of money was inserted, and powers-down the apparatus to return to the nap mode after dispensing.

2. The apparatus of claim 1, further comprising:

a coin sensor for sensing the insertion of a coin;

a coin mechanism for testing coins;

a money acceptance testing means for determining if only coins or if coins and paper currency can be accepted; and a money indication means for indicting to a user if only coins or if paper currency and coins may be inserted;

wherein the control means is connected to the coin sensor, the coin mechanism, the money acceptance testing means and the money indication means, and wherein the control means can power-up the apparatus when either a coin or paper currency is sensed and can activate the coin mechanism, the money acceptance testing means and the money indication means.

3. A solely battery-powered, money-operated dispensing apparatus, comprising:

a battery;

a delivery means;

a bill sensor for sensing the insertion of paper currency;

a bill validator for testing paper currency;

a coin sensor for sensing the insertion of a coin; and a coin mechanism for testing coins, wherein the coin mechanism contains a control means connected to the battery, the delivery means, the bill sensor, the coin sensor and the bill validator, and wherein the control means normally operates in a low-power nap mode to conserve power, strobes the coin and bill sensors during the nap mode and powers-up the apparatus and actuates the coin and bill validators when a coin insertion or paper currency insertion is sensed, activates the delivery means if an adequate amount of money was inserted and powers-down the apparatus to return to the nap mode after dispensing.

4. The apparatus of claim 3, further comprising:

a money acceptance testing means for determining if only coins or if coins and paper currency can be accepted; and a money indication means for indicating to a user if only coins or if paper currency and coins may be inserted.

5. The apparatus of claim 1 or 3, further comprising:

a power conservation circuit for limiting power to the delivery means;

wherein the control means activates the power conservation circuit a predetermined time after the delivery means is activated.

6. The apparatus of claim 1 or 3, further comprising:

a battery testing means for automatically and periodically testing the battery to determine if a predetermined amount of power is available in the battery, and for producing a low-power signal if power is low; and a low-power display means for indicating a low battery power condition only if the low-power signal is produced and if the apparatus is being used or serviced.

7. The apparatus of claim 1 or 3, wherein the delivery means is an electrical solenoid.

8. The apparatus of claim 2 or 3, further comprising:

a money change making means for providing change to a user.

9. The apparatus of claim 1 or 3, further comprising:

a multiple price switching means for varying the adequate amount of money required to activate the delivery means.

10. The apparatus of claim 9, further comprising:

an electronic timing device for causing the price to change at predetermined intervals.

11. A method for vending and dispensing from a solely battery-powered apparatus comprising the steps of:

powering the apparatus with at least one battery;
operating the apparatus in a low power nap mode;
strobing a bill sensor during the low power nap mode to check for the insertion of paper currency;
powering-up the apparatus from the low power nap mode when paper currency is sensed;
electronically testing the paper currency;
dispensing if the amount of money inserted equals or exceeds a predetermined amount;
powering-down the apparatus after dispensing; and
entering the low power nap mode to conserve battery power.

12. The method of claim 11, wherein the step of dispensing further comprises:

a) charging an energy storing device;
b) discharging the energy storing device to power a product delivery means when an activation signal occurs;
c) reducing the power supplied to the product delivery means a predetermined time after the activation signal occurs; and
d) recharging the energy storing device after completion of steps a) to c) above.

13. The method of claim 11, further comprising:

automatically and periodically testing the battery to determine whether a predetermined amount of power is available in the battery; and
indicating a low power condition if the power level of the battery is below a predetermined limit and if the apparatus is being used or is being serviced.

14. The method of claim 11, further comprising:

strobing a coin sensor during the low power nap mode to check for the insertion of a coin;
powering-up the apparatus from the nap mode when a coin is inserted into the apparatus;
electronically testing the coin;
determining if the apparatus can accept only coins or if it can accept coins and paper currency; and
setting a display means to indicate that only coins or that coins and paper currency can be accepted.

15. The method of claim 14, wherein the determining step further comprises:

determining the contents of a coin storage means and generating a coin storage signal if the amount of coins is below a predetermined number;
generating a display signal if the display means is indicating that coins and paper currency can be inserted; and
changing the display means to indicate that only coins may be inserted if the coin storage signal and the display signal are both generated.

* * * * *

UNITED STATES PATENT AND TRADEMARK OFFICE

CERTIFICATE OF CORRECTION

PATENT NO. : 5,316,124

DATED : May 31, 1994

INVENTOR(S) : Barnes et al.

It is certified that error appears in the above-identified patent and that said Letters Patent is hereby corrected as shown below:

Col. 7, line 34, after "When", insert --not--.

Col. 7, line 66, cancel "Halleffect" and insert --Hall effect--.

Col. 19, line 14, cancel "flip--flop" and insert --flip-flop--.

Col. 24, line 15, cancel "AZS-1C-24DE" and insert --AZ8-1C-24DE--.

Signed and Sealed this

Sixteenth Day of February, 1999

*Attest:*

*Attesting Officer*

*Acting Commissioner of Patents and Trademarks*